US007033005B2

(12) United States Patent
Nakamura

(10) Patent No.: US 7,033,005 B2
(45) Date of Patent: Apr. 25, 2006

(54) METHOD OF, AND APPARATUS FOR, FILLING LIQUID DROPLET EJECTION HEAD WITH FUNCTION LIQUID; LIQUID DROPLET EJECTION APPARATUS; ELECTROOPTIC DEVICE; METHOD OF MANUFACTURING ELECTROOPTIC DEVICE; AND ELECTRONIC APPARATUS

(75) Inventor: Shinichi Nakamura, Okaya (JP)

(73) Assignee: Seiko Epson Corporation, (JP)

( * ) Notice: Subject to any disclaimer, the term of this patent is extended or adjusted under 35 U.S.C. 154(b) by 239 days.

(21) Appl. No.: 10/716,940

(22) Filed: Nov. 19, 2003

(65) Prior Publication Data

US 2004/0141023 A1 Jul. 22, 2004

(30) Foreign Application Priority Data

Nov. 26, 2002 (JP) ..... 2002-342713
Aug. 21, 2003 (JP) ..... 2003-297220

(51) Int. Cl.
*B41J 2/175* (2006.01)

(52) U.S. Cl. ..... 347/85

(58) Field of Classification Search ..... 347/22–35, 347/92, 85, 89

See application file for complete search history.

(56) References Cited

U.S. PATENT DOCUMENTS 6,830,855 B1 * 12/2004 Kiguchi et al. ..... 430/7

FOREIGN PATENT DOCUMENTS

| | | | |
|---|---|---|---|
| JP | 04-070353 | 3/1992 | |
| JP | 404070351 A * | 3/1992 | ..... 347/92 |
| JP | 10-151763 | 6/1998 | |
| JP | 10-286974 | 10/1998 | |
| JP | 2000-211157 | 8/2000 | |

OTHER PUBLICATIONS

Communication from Korean Patent Office re: related application., Sep. 5, 2005-036153212, Jul. 29, 2005, Notice of Rejection.

* cited by examiner

*Primary Examiner*—Shih-Wen Hsieh
(74) *Attorney, Agent, or Firm*—Harness, Dickey & Pierce, P.L.C.

(57) ABSTRACT

A function liquid is sent under pressure into the flow passages inside the liquid droplet ejection heads. Thereafter, the function liquid is sucked from nozzles of the liquid droplet ejection heads. In filling the liquid function droplet ejection heads with a function liquid, air bubbles in the flow passages inside the liquid droplet ejection heads can be efficiently discharged, whereby the liquid droplet ejection head is surely filled with the function liquid.

17 Claims, 30 Drawing Sheets

METHOD OF, AND APPARATUS FOR, FILLING LIQUID DROPLET EJECTION HEAD WITH FUNCTION LIQUID; LIQUID DROPLET EJECTION APPARATUS; ELECTROOPTIC DEVICE; METHOD OF MANUFACTURING ELECTROOPTIC DEVICE; AND ELECTRONIC APPARATUS

BACKGROUND OF THE INVENTION

1. Field of the Invention

This invention relates to a method of filling a liquid droplet ejection head of ink jet system with a function liquid such as ink, or the like; a liquid droplet ejection apparatus; an electrooptic device; a method of manufacturing the electrooptic device; and an electronic apparatus.

2. Description of the Related Art

In a liquid droplet ejection apparatus as represented by an ink jet printer, the following arrangement is conventionally employed. Namely, when a flow passage inside an ink jet head (liquid droplet ejection head) is filled with an ink, a positive pressure is given to an ink tank (function liquid storing part) in which the ink is stored so as to send or feed the ink under pressure (i.e., in a pressurized state) from the ink tank to the ink jet head through a tube (see, e.g., Published Unexamined Japanese Patent Application No. 2000-21157, FIG. 2 and related description).

To the contrary, there is also known one in which, when the ink is filled, the ink jet head is sealed by a cap. By driving a suction pump which is connected to the cap, a negative pressure is given to the flow passage inside the ink jet head and to the tube to thereby feed the ink from the ink tank (see, e.g., Published Unexamined Japanese Patent Application No. 286974/1998, FIG. 5 and related description).

If air bubbles remain or stay in the flow passage inside the ink jet head, the liquid droplet ejection head causes poor ejection from the nozzles. On the other hand, in the liquid droplet ejection apparatus to be used in forming various film-forming parts of a color filter, organic electroluminescence (EL) device, or the like, there are cases in which function liquids such as special inks from which air bubbles cannot be completely removed are used.

In the conventional filling method using the negative pressure, there is a possibility that air bubbles are generated in the tube and in the flow passage inside the liquid droplet ejection head, depending on the characteristics of the function liquid, due to the gases held in solution inside the function liquid. In such a case, in order to remove the residual air bubbles, the necessity arises of discharging the air bubbles together with the function liquid droplet out of the flow passage inside the head through the nozzle by repeating the suction several times. This results in a wasteful consumption of expensive function liquids.

On the other hand, in the conventional filling method using the positive pressure, the air bubbles will not be generated in the tube and in the flow passage inside the head at the time of filling. However, there is a problem in that, if air bubbles stay in the corner portion of the flow passage inside the head (i.e., inside the main body portion of the head) due to the surface tension of the function liquid, these air bubbles cannot easily be discharged toward the nozzle by the liquid feeding under positive pressure.

SUMMARY OF THE INVENTION

In view of the above points, this invention has an advantage of providing a method of and an apparatus for filling a liquid droplet ejection head with a function liquid in which the air bubbles in a flow passage inside the liquid droplet ejection head can be efficiently discharged. This invention further provides a liquid droplet ejection apparatus, an electrooptic device, a method of manufacturing the electrooptic device, and an electronic apparatus.

In order to attain the above and other advantages, there is provided a method of filling a flow passage inside a liquid droplet ejection head with a function liquid, comprising the steps of: sending under pressure the function liquid for filling into the flow passage inside the liquid droplet ejection head; and thereafter sucking the function liquid out of a nozzle of the liquid droplet ejection head.

According to this method, the function liquid is sent under pressure to the liquid droplet ejection head in a positive pressure and is thereafter sucked from the liquid droplet ejection head which is subjected to a negative pressure. The filling of the function liquid into the fluid passage inside the liquid droplet ejection head is thus completed. Since the positive pressure is used first, the liquid droplet ejection head can be filled with the function liquid while keeping the generation of air bubbles to the smallest extent possible. By finally using the negative pressure, even if air bubbles remain in the flow passage inside the liquid droplet ejection head, the remaining or residual air bubbles can be enlarged or expanded due to the pressure reduction effect. The residual air bubbles can thus be adequately discharged together with the function liquid through the nozzle of the liquid droplet ejection head.

In this manner, since the function liquid is filled into the liquid droplet ejection head by combining the positive pressure and the negative pressure, the generation and staying of the air bubbles can be adequately kept under control, and the passage inside the function liquid droplet ejection head can be filled (or packed) with the function liquid closely or fully without clearance.

Preferably, a flow velocity of the function liquid at each part in the step of sending the liquid under pressure is lower than a flow velocity of the function liquid at each part in the step of sucking the function liquid.

According to this arrangement, at the time of filling the function liquid in a positive pressure, the function liquid can be sent in a state in which the generation of air bubbles is kept under control due to the relatively low flow velocity. At the time of sucking the function liquid in the negative pressure, since the flow velocity is relatively high, the residual air bubbles can be adequately discharged together with the function liquid.

Preferably, the step of sucking is performed in a state in which a suction cap is closely adhered to the liquid droplet ejection head, and the step of sending the function liquid under pressure is performed in a state in which the function liquid to be discharged from the nozzle is capable of being received by the suction cap.

According to this arrangement, the negative pressure is given or applied to the liquid droplet ejection head through the suction cap to thereby suck the function liquid. This suction cap can receive the function liquid that could be discharged (or leaks) from the function liquid droplet ejection head as a result of the initial sending of liquid under pressure. In this manner, the liquid droplet can be prevented from scattering by making use of the cap. The suction cap may be kept adhered to the liquid droplet ejection head from the time of the step of sending the function liquid under pressure.

Preferably, the step of sucking the function liquid is performed in a state in which the suction cap is kept adhered to the liquid droplet ejection head and, at a final stage, the suction cap is departed while continuing the sucking operation.

According to this arrangement, the residual air bubbles that have been discharged into the suction cap as a result of sucking can be prevented from flowing backward into the liquid droplet ejection head at the final stage in which the adhesion of the suction cap is released. In other words, after having discharged the air bubbles, the suction cap is released or departed from the liquid droplet ejection head while applying the negative pressure. Thus, even if the liquid droplet ejection head is opened to atmosphere, the air bubbles once discharged will not flow back and, also, the meniscus of the function liquid in the liquid droplet ejection head can be stabilized.

Preferably, the method further comprises the step of, after the step of sucking the function liquid, temporarily sending under pressure the function liquid to the liquid droplet ejection head.

According to this arrangement, after having discharged the air bubbles, the function liquid is given again the positive pressure. The meniscus of the function liquid in the liquid droplet ejection head can thus be stabilized.

According to another aspect of this invention, there is provided an apparatus for filling a flow passage inside a liquid droplet ejection head with a function liquid inside a function liquid storing part, comprising: pressurized liquid sending means for sending under pressure the function liquid, by pressurizing the function liquid storing part, to thereby fill the flow passage inside the liquid droplet ejection head with the function liquid inside the function liquid storing part through a supply passage; sucking means for sucking the function liquid out of a nozzle of the liquid droplet ejection head through a cap which is in close contact with the liquid droplet ejection head; control means for controlling the pressurized liquid sending means and the sucking means, wherein the control means drives the pressurized liquid sending means to thereby fill the flow passage inside a liquid droplet ejection head and thereafter drives the sucking means to thereby suck the function liquid from the liquid droplet ejection head.

According to this arrangement, the function liquid is sent in a state of being pressurized from the function liquid storing part to the liquid droplet ejection head at a positive pressure, and is then sucked through the cap by the liquid droplet ejection head which is subjected to a negative pressure, thereby being filled from the supply passage into the flow passage inside the liquid droplet ejection head. In this case, since the positive pressure is used at the beginning, the function liquid can be supplied to the liquid droplet ejection head while keeping the generation of the air bubbles to the minimum extent possible. In addition, by finally using the negative pressure, even if the air bubbles stay in the flow passage inside the liquid droplet ejection head, the residual air bubbles are enlarged or expanded due to the pressure reduction effect. Therefore, the residual air bubbles can be adequately discharged together with the function liquid out of the nozzle of the liquid droplet ejection head.

In this manner, since the filling work is performed by combining the positive pressure and the negative pressure, the generation and staying or residing of the air bubbles can be adequately restricted irrespective of the de-aeration ratio of the function liquid. The function liquid can thus be filled into the flow passage inside the liquid droplet ejection head without clearance.

Preferably, the control means starts the driving of the suction means after the driving of the pressurized liquid sending means is stopped.

According to this arrangement, the negative pressure is adequately applied to the flow passage inside the liquid droplet ejection head. Therefore, the residual air bubbles can surely be discharged.

Preferably, the pressurized liquid sending means comprises: a compressed air supply source for supplying the function liquid storing part with compressed air; a pressurizing pipe which connects the compressed air supply source and the function liquid storing part; a pressurizing-side gate valve which is interposed in the pressurizing pipe and which is controlled to be opened and closed by the control means. Driving and stopping of the pressurized liquid sending means are made by opening and closing of the pressurizing-side gate valve.

According to this arrangement, by the opening and closing of the pressurizing-side gate valve, the driving of, and the stoppage of the driving of, the pressurized liquid sending means for the function liquid can be easily and appropriately executed.

Preferably, the apparatus further comprises a gate valve which is interposed in the supply passage and which is opened and closed by the control means. The control means closes the gate valve before start of driving of the suction means, starts driving of the suction means after closing the gate valve, and opens the gate valve while the suction means is being driven.

According to this arrangement, the gate valve closes first, and the negative pressure is surely applied to the flow passage inside the liquid droplet ejection head, thereby expanding the residual air bubbles. By thereafter opening the gate valve, the function liquid flows due to the continued suction and, at that time, the expanded air bubbles get entrained in (or caught by) the flow of the function liquid. In this manner, by opening the gate valve in the course of employing the negative pressure, the residual air bubbles can be adequately expanded and, therefore, be surely discharged.

Preferably, the control means opens and closes the gate valve for a plurality of times while the suction means is being driven.

According to this arrangement, since pulsation temporarily occurs in the flow passage inside the liquid droplet ejection head, even the air bubbles sticking to the flow passage inside the liquid droplet ejection head can be discharged well.

Preferably, the gate valve is interposed in the supply passage close to the liquid droplet ejection head.

According to this arrangement, the negative pressure can be quickly applied to the liquid droplet ejection head. Therefore, the residual air bubbles can be efficiently expanded and discharged while minimizing the amount of discharging of the function liquid by the suction means.

Preferably, the control means controls the pressurized liquid sending means and the suction means such that a flow velocity of the function liquid by the pressurized liquid sending means becomes smaller than a flow velocity of the function liquid by the suction means.

According to this arrangement, when the function liquid is being filled in the positive pressure, the flow velocity is relatively low, and the function liquid can, therefore, be sent in a state in which the generation of air bubbles is adequately restricted. On the other hand, when the function liquid is being sucked in the negative pressure, the flow velocity is relatively high, and the air bubbles can, therefore, be appropriately discharged together with the function liquid.

Preferably, the cap also serves as a receptacle to receive the function liquid to be discharged from the nozzle of the liquid droplet ejection head as a result of driving of the pressurized liquid sending means.

According to this arrangement, the function liquid that could be discharged (or leaked) from the liquid droplet ejection head accompanied by the initial pressurized feeding thereof can be received by the cap. As a result, the cap can be effectively used and the function liquid can be prevented from being spread. The cap may be held adhered to, or be held in intimate contact with, the liquid droplet ejection head from the stage of pressurized sending of the function liquid.

Preferably, the suction means comprises an access-and-departure mechanism for relatively moving the cap toward, and away from, the liquid droplet ejection head and, at a last stage, the control means moves, by the access-and-departure mechanism, the cap away from the liquid droplet ejection head by the driving of the suction means while continuing the driving of the suction means.

According to this arrangement, the residual air bubbles discharged, by suction, to the cap is prevented from flowing back to the liquid droplet ejection head at the last stage in which the cap is released from adhesion. In other words, after having discharged the air bubbles, the cap is moved away from the liquid droplet ejection head while keeping on applying the negative pressure. Therefore, even if the liquid droplet ejection head is opened to atmosphere, the residual air bubbles once discharged will never be caused to flow backward. At the same time, the meniscus of the function liquid at the liquid droplet ejection head can be stabilized.

Preferably, the control means temporarily drives the pressurized liquid sending means after the driving of the suction means has been stopped.

According to this arrangement, after the air bubbles have been discharged, the negative pressure is applied to the function liquid again. The meniscus of the function liquid at the liquid droplet ejection head can thus be stabilized.

According to another aspect of this invention, there is provided a liquid droplet ejection apparatus comprising: a function liquid filling apparatus for the liquid droplet ejection head as described above; and a liquid droplet ejection head for ejecting the function liquid from the nozzle by performing scanning relative to the workpiece.

According to this arrangement, since the liquid droplet ejection head is adequately filled with the function liquid, the poor ejection (so-called failure of dots) can be prevented, thereby appropriately ejecting the function liquid toward the workpiece. The workpiece includes various substrates for a color filter, or the like, a recording medium such as cut paper.

Preferably, the apparatus further comprises a main tank which stores the function liquid to be supplied to the function liquid storing part and which causes the function liquid storing part to serve as a sub-tank, and the pressurized liquid sending means also serves a function of supply means for supplying the function liquid from the main tank to the function liquid storing part.

According to this arrangement, even if the function liquid in the function liquid storing part reduces in quantity, the function liquid can be supplemented from the main tank to the function liquid storing part. As a result, by utilizing the pressurized liquid sending means, the difference in water head pressure between the liquid droplet ejection head and the function liquid storing part can be adequately maintained. Therefore, the ejection of the function liquid toward the workpiece can be adequately performed and the apparatus as a whole can be minimized.

According to still another aspect of this invention, there is provided an electrooptic device comprising a film forming part which is formed on a substrate by the function liquid ejected from the liquid droplet ejection head by using the liquid droplet ejection apparatus as set forth hereinabove.

According to still another aspect of this invention, there is provided a method of manufacturing an electrooptic device comprising the step of forming on a substrate a film forming part by ejecting the function liquid from the function liquid droplet ejection by using the liquid droplet ejection apparatus.

According to the above arrangement, the manufacturing is made by using the liquid droplet ejection apparatus which is capable of surely performing the ejection of the function liquid. Therefore, the yield of the electrooptic device can be improved. As the electrooptic device, there can be considered a liquid crystal display device, an organic electroluminescence (EL) device, an electron emission device, a plasma display panel (PDP) device, an electrophoretic display device, or the like. The electron emission device is a concept inclusive of a so-called field emission display (FED) device and a surface conduction electron emitter display (SED) device. Further, as the electrooptic device, there can be included an apparatus for forming a metallic wiring, an apparatus for forming a lens, an apparatus for forming a resist, an apparatus for forming a light diffusion body, or the like.

According to still another aspect of this invention, there is provided an electronic apparatus comprising the electrooptic device as set forth hereinabove.

According to this arrangement, there can be provided an electronic apparatus which has mounted thereon a high-performance electrooptic device. As the electronic apparaus, there can be included a mobile phone, a personal computer, various electric devices having mounted therein a so-called flat panel display

BRIEF DESCRIPTION OF THE DRAWINGS

The above and other objects and the attendant features of this invention will become readily apparent by reference to the following detailed description when considered in conjunction with the accompanying drawings wherein.

DETAILED DESCRIPTION OF THE PREFERRED EMBODIMENTS

With reference to the accompanying drawings, a description will now be made about the method of, and an apparatus for, filling a liquid droplet ejection head with a function liquid, and a liquid droplet ejection apparatus. This liquid droplet ejection apparatus is to be built into a line of manufacturing a flat panel display such as an organic electroluminescence (EL) device, or the like. An image (or picture) drawing is made with an ink jet system by selectively ejecting from a liquid droplet ejection apparatus a function liquid such as a filter material, an emitting material, or the like, toward a substrate (workpiece). A predetermined film forming part is thus formed on the substrate.

Figure 6A:
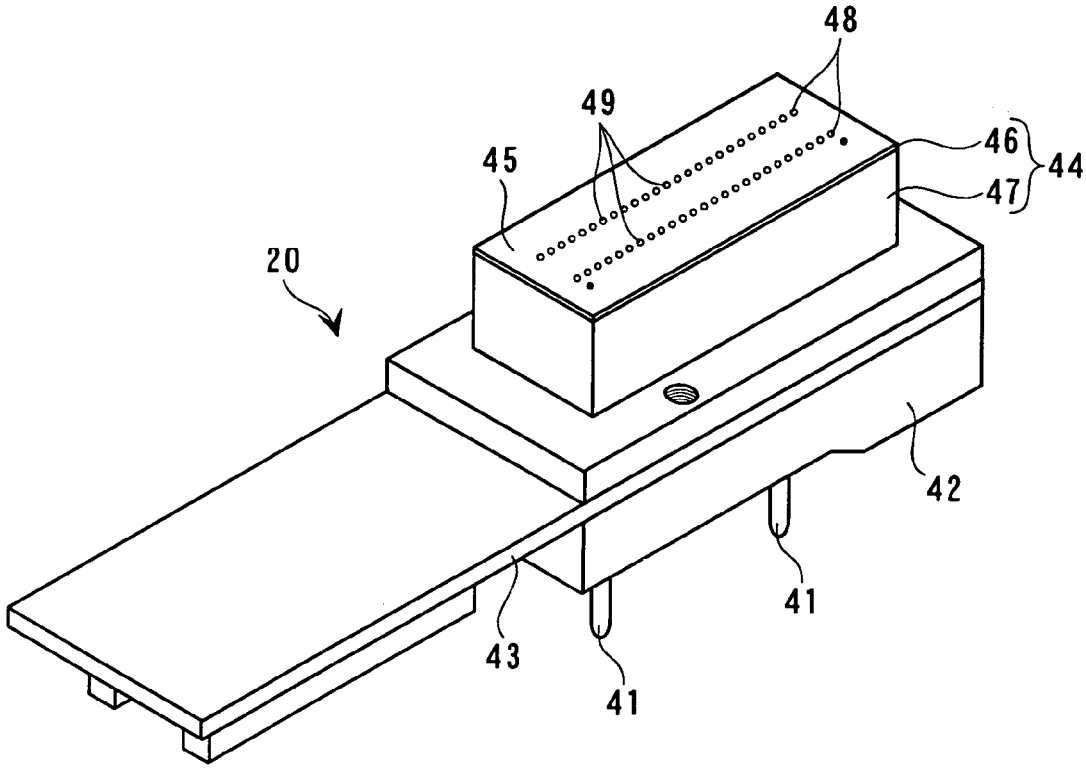
FIG. 6A is a perspective view of, and FIG. 6B is a sectional view of, the liquid droplet ejection head according to an embodiment of this invention.
Figure 6B:
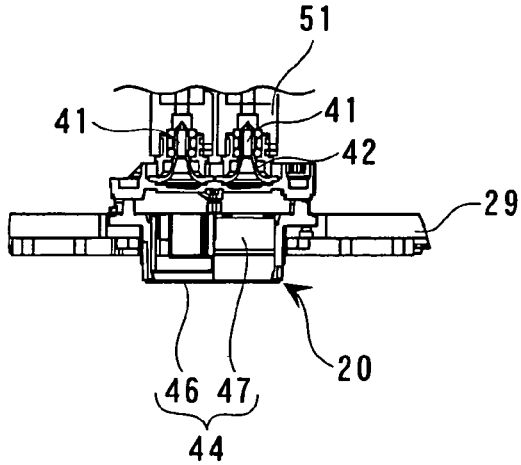

As shown in FIGS. 1 through 4, the liquid droplet ejection apparatus 1 is made up of: ejecting means 2 which has liquid droplet ejection heads 20 as shown in FIGS. 6A and 6B and which ejects function liquids; maintenance means 3 which performs maintenance work of the liquid droplet ejection heads 20; liquid supply and recovery means 4 which supplies the liquid droplet ejection heads 20 with the function liquids and which also recovers the liquids such as the function liquids that have become unnecessary; air supply means 5 which supplies compressed air for driving and controlling each of the means such as the liquid supply and recovery means 4; and control means (not illustrated) which performs an overall control over each of the above-described means and apparatuses.

In the following description, elements/members which are actually present in more than one in number will sometimes be referred to as a single element/member. It is to be understood that such a reference is made to a representative one out of a plurality of elements/members only for the sake of simplicity.

The liquid droplet ejection apparatus 1 is made up of: a base 11 which is made by forming structural members of L-shape in cross section (so-called angular members) into a rectangle; a machine base 12 which is attached to the base 11; and a stone surface table (or surface board) 13 which is fixed to an upper portion of the base 11. Above the stone surface table 13 is disposed the ejecting means 2. A workpiece W (substrate, see FIG. 4) which is an object to which the function liquids are ejected is set in position on the stone surface table 13 so as to correspond to the liquid droplet ejection heads 20 which are positioned above the workpiece W. The workpiece W is made of a glass substrate, polyimide substrate, or the like.

Figure 1:
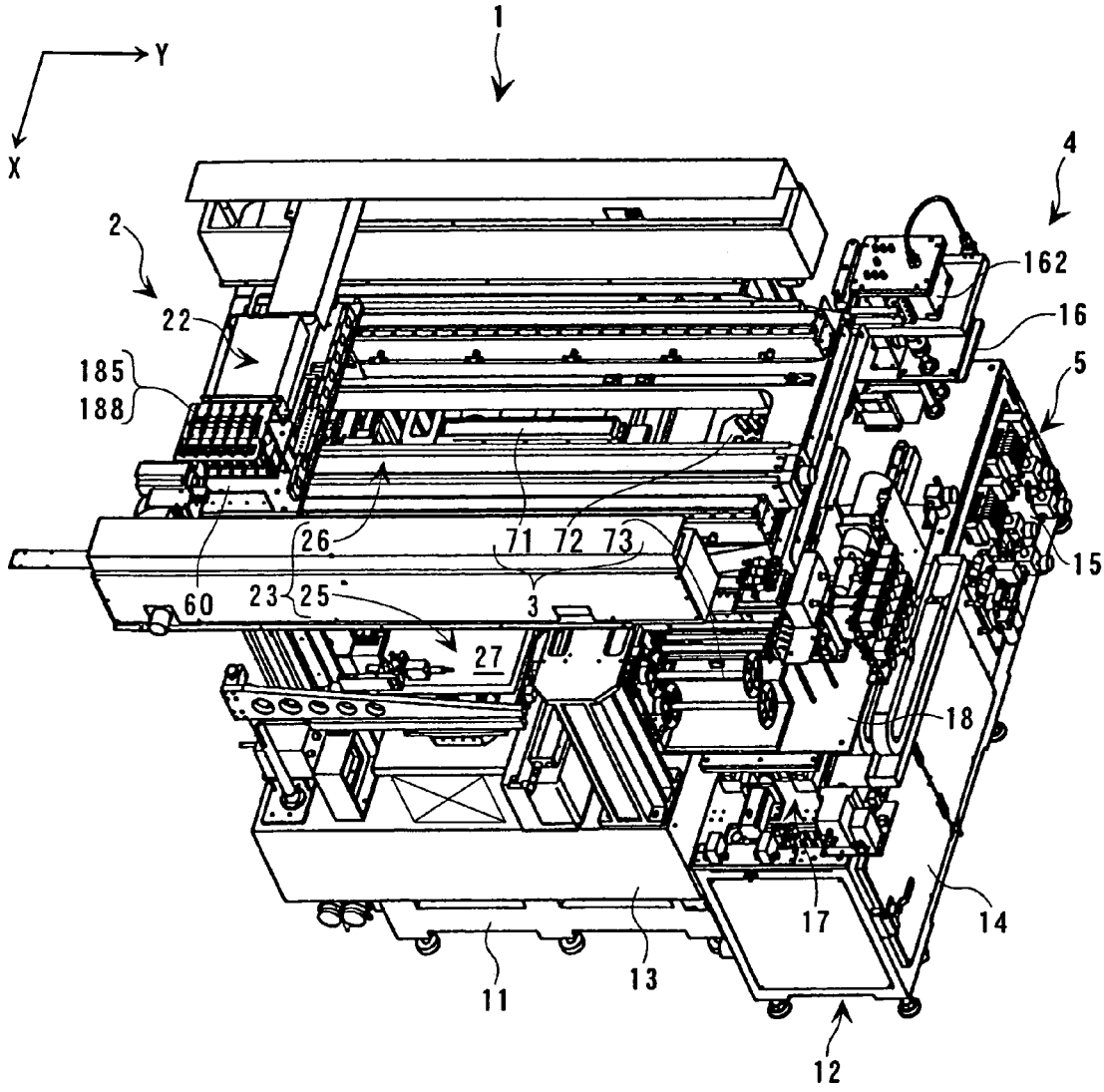
FIG. 1 is a perspective view of a liquid droplet ejection head according to an embodiment of this invention.

The machine base 12 is made up of: a larger housing chamber 14 which is located on this (lower) side as seen in FIG. 1 and which houses or contains therein tanks such as a main tank 161, or the like, for the liquid supply and recovery means 4; a smaller housing chamber 15 which is located on the upper side as seen in FIG. 1 and which houses therein the main parts of the air supply means 5; a tank base 16 which is disposed on the smaller housing chamber 15 and which mounts thereon a liquid supply sub-tank 162 (to be described hereinafter) of the liquid supply/recovery means 4, the liquid supply sub-tank 162 serving as a sub-tank of the main tank 161; and a moving table 17 which is disposed on the larger housing chamber 14 and which is supported so as to be slidable in a longitudinal direction of the machine base 12 (i.e., in the X-axis direction). The moving table 17 has fixed thereto a common base 18 on which are mounted a suction unit 72 and a wiping unit 74 (both to be described hereinafter) of the maintenance means 3.

The ejection means 2 is made up of: a head unit 21 which has a plurality of liquid droplet ejection heads 20; a main carriage 22 on which is mounted the head unit 21; and an X/Y moving mechanism 23 which performs a relative movement, in the X/Y axis direction, of the head unit 21 through main carriage 22 relative to the workpiece W. The X/Y moving mechanism 23 is disposed on the stone surface table 13 and is made up of: an X-axis table 25 which moves the workpiece W in the X-axis direction; and a Y-axis table 26 which moves the main carriage 22 in the Y-axis direction at right angles to the X-axis table. The X-axis table 25 whose moving system is mainly constituted by a linear motor moves the workpiece W in the X-axis direction through a suction table 27 (see FIG. 4) which has mounted thereon the workpiece W by suction. The Y-axis table 26 whose moving system is mainly constituted by a ball screw is disposed above the X-axis table 25 in a manner to bridge it.

In a series of ejecting operations by the ejecting means 2, a plurality of liquid droplet ejection heads 20 are selectively driven for ejection in a manner synchronized with the movement in the main scanning direction (X-axis direction) of the workpiece W by the X-axis table 25. In other words, the so-called main scanning of the liquid droplet ejection heads 20 is performed in the back-and-forth movement of the workpiece W by the X-axis table 25. The so-called sub-scanning corresponding to the main scanning is performed in the back-and-forth movement in the Y-axis direction of the liquid droplet ejection heads 20 by the Y-axis table 26. This movement in the Y-axis direction is feeding by a pitch in the ball screw. In this manner, by performing relative main scanning and sub-scanning between the workpiece W and the liquid droplet ejection heads 20, the imaging operation of ejecting the function liquids to the predetermined positions on the workpiece W is performed based on data stored in the control means.

Alternatively, the following arrangement may also be employed. Namely, although in the above embodiment, the workpiece W is arranged to be moved in the main scanning direction relative to the liquid droplet ejection heads 20 (head unit 21), the liquid droplet ejection heads 20 may be arranged to be moved in the main scanning direction. Or else, the workpiece W is fixed and the liquid droplet ejection heads 20 may be arranged to be movable in the main scanning direction and the sub-scanning direction.

Figure 3:
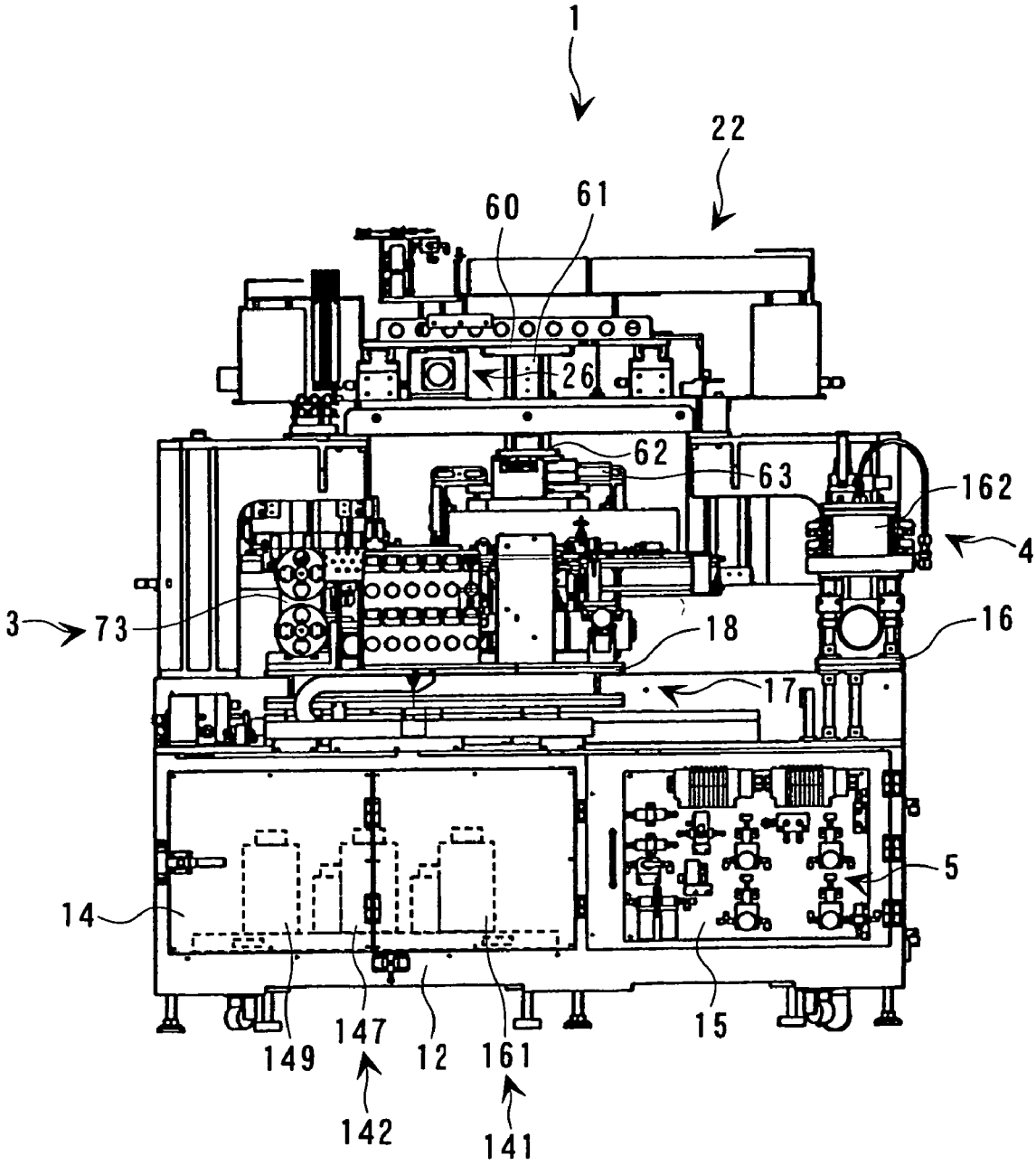
FIG. 3 is a right side view thereof.
Figure 5:
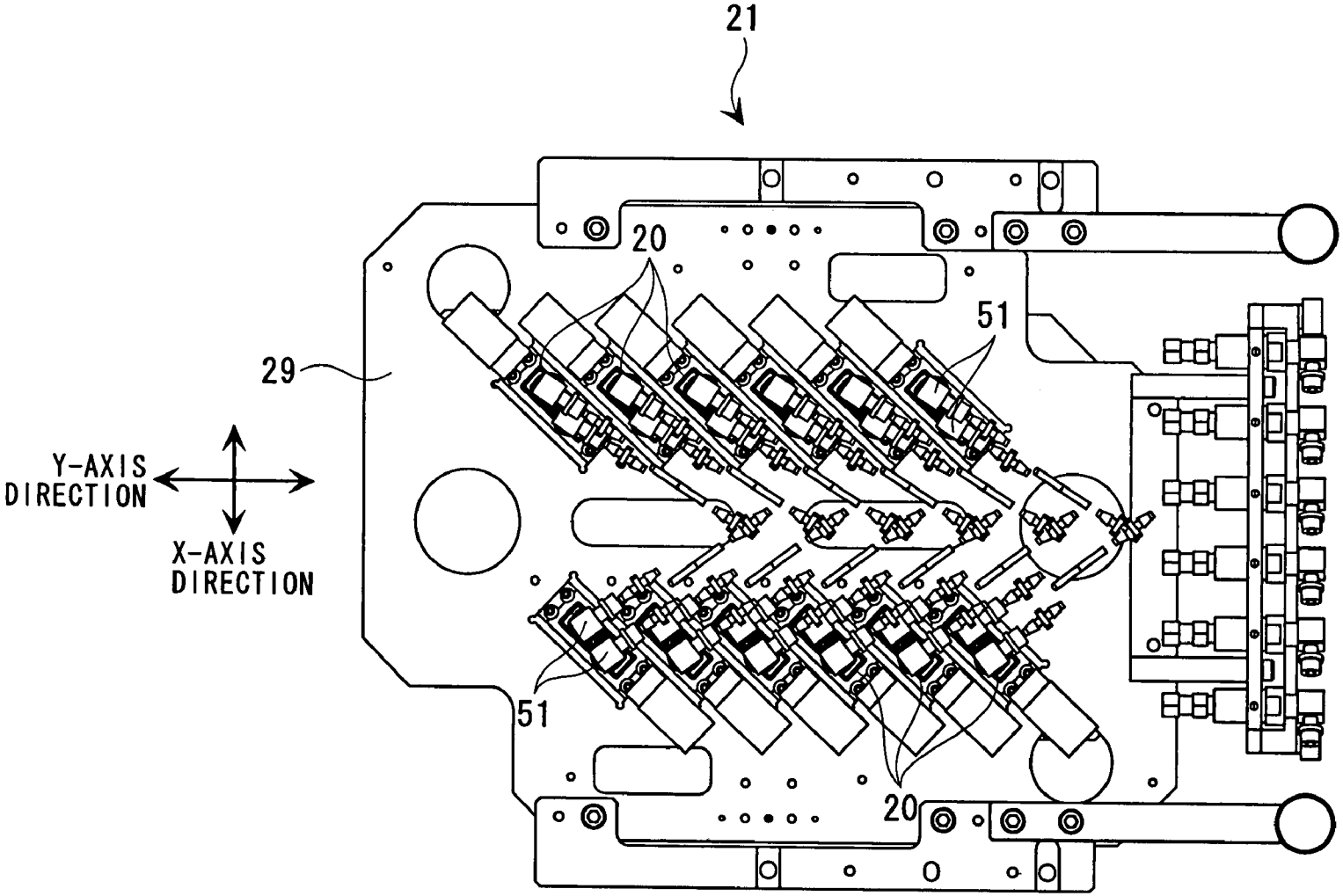
FIG. 5 is a plan view of a head unit according to an embodiment of this invention.

As shown in FIGS. 5 and 6, the head unit 21 has a sub-carriage 29 for mounting thereon a plurality of (twelve) liquid ejection heads 20, and is fixed to the main carriage 22 at the sub-carriage 29. The main carriage 22 is made up, as shown in FIGS. 1 and 3, of: a suspension member 61 which is I-shaped in external appearance and which is fixed from the lower side to a bridge plate 60 of the Y-axis table 26; a Θ table 62 which is attached to the lower surface of the suspension member 61; and a carriage main body 63 which is attached in suspension to the lower side of the Θ table 62. The carriage main body 63 has a square opening for loosely fitting therethrough the sub-carriage 29 so that the head unit 21 can be fixed in position.

As shown in FIGS. 6A and 6B, the liquid droplet ejection heads 20 are of a so-called twin or dual row type and each is made up of: a function liquid introduction part 42 which has a twin type of connection needles 41; and a head main body 44 which is communicated with a lower side (upper side in the illustration in FIG. 6A) of the function liquid introduction part 42 and which has formed therein those flow passages inside the head which are filled with the function liquid. This type of liquid droplet ejection heads 20 of ink jet system are constituted by an energy generating element using a piezoelectric element or an electothermal converting member.

Each of the connection needles 41 is connected to the liquid supply sub-tank 162 through a piping adapter 51. The function liquid introduction part 42 is so arranged as to receive the supply of the function liquid from each of the connection needles 41. In other word, the function liquid is supplied under pressure by the air supply means 5 from the main tank 161 of the liquid recovery means to the liquid supply sub-tank 162. Also, the function liquid is separated in point of pressure at this liquid supply sub-tank 162, and is supplied from this liquid supply sub-tank 162 by branching into each of the liquid droplet ejection heads 20 (details to be given hereinafter with reference to FIG. 11).

The head main body 44 is made up of: a nozzle forming plate 46 having a nozzle surface 45; and twin type of pump parts 47 which are communicated with the nozzle forming plate 46 and are rectangular parallelepiped in shape. Each of the liquid droplet ejection heads 20 is formed such that the head main body 44 is projected from the lower surface of the sub-carriage 29. In the lower surface of the head main body 44, i.e., in the nozzle surface 45 which parallelly faces the workpiece W, two nozzle rows 48 are formed in parallel with each other. Each of the nozzle rows 48 is extended substantially in the main scanning direction and has formed therein 180 nozzles, for example, arranged at an equal pitch therebetween. The liquid droplet ejection heads 20 are arranged to eject the function liquid in the shape of dots from the nozzles 49.

The twelve liquid droplet ejection heads 20 are divided into two rows of six each and are disposed in the main scanning direction (X-axis direction) at a distance from each other. In order to secure a sufficient coating density of the function liquid to the workpiece W, each of the liquid droplet ejection heads 20 is disposed at a predetermined angle. In addition, each of the liquid droplet ejection heads 20 in one row and in the other row is respectively disposed at a positional deviation from one another in the sub-scanning direction (Y-axis direction) so that the nozzles 49 of each of the liquid droplet ejection heads 20 are continuous in the sub-scanning direction.

Figure 4:
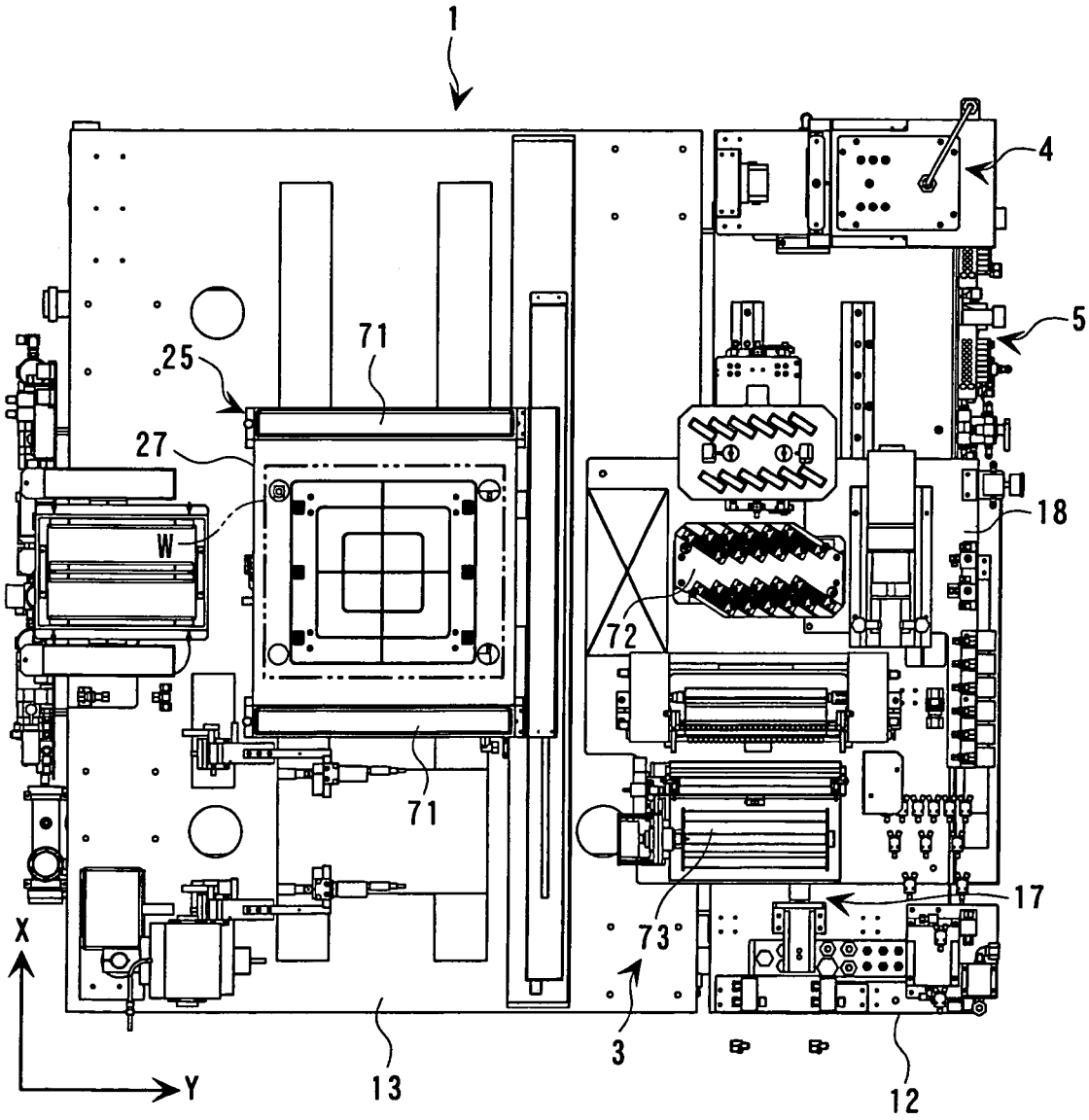
FIG. 4 is a plan view thereof with part of the liquid droplet ejection head omitted.

The maintenance means 3 is to keep the liquid droplet ejection heads 20 in well-maintained state so that the liquid ejection heads 20 can appropriately eject the function liquid, and is made up, as shown in FIG. 4, of: a pair of flushing boxes 71 which are disposed on the side of the base 11; a suction unit 72 which is disposed on the side of the machine base 12; and a wiping unit 73 which is disposed next to the suction unit 72.

The pair of the flushing boxes 71 are to receive the flushing of plurality of liquid droplet ejection heads 20 (here, the term "flushing" means a preliminary ejection from all of the nozzles 49 in a manner to throw away the function liquid droplets). The flushing boxes 71 are fixed to the X-axis table 25 with the suction table 27 therebetween. The flushing boxes 71 are moved, in te imaging operation, by the X-axis table 25 toward the liquid droplet ejection heads 20 (head unit 21) together with the workpiece W at the time of the main scanning. Flushing is performed sequentially (by each row) and periodically from the liquid droplet ejection heads 20 which face the flushing boxes 71. The function liquid received by each of the flushing boxes 71 is stored in a waste liquid tank 149 (see FIG. 3).

The suction unit 72 is placed on the common base 18 of the machine base 12 and is constituted in a manner slidable in the X-axis direction through the moving table 17 to which is fixed the common base 18. The suction unit 72 is to forcibly suck the function liquid from the liquid droplet ejection heads 20 and is used in performing the cleaning to remove the function liquid that has increased its viscosity inside the liquid droplet ejection heads 20 or in initial filling of the liquid droplet ejection heads 20 of the head unit 21 with the function liquid.

Figure 7:
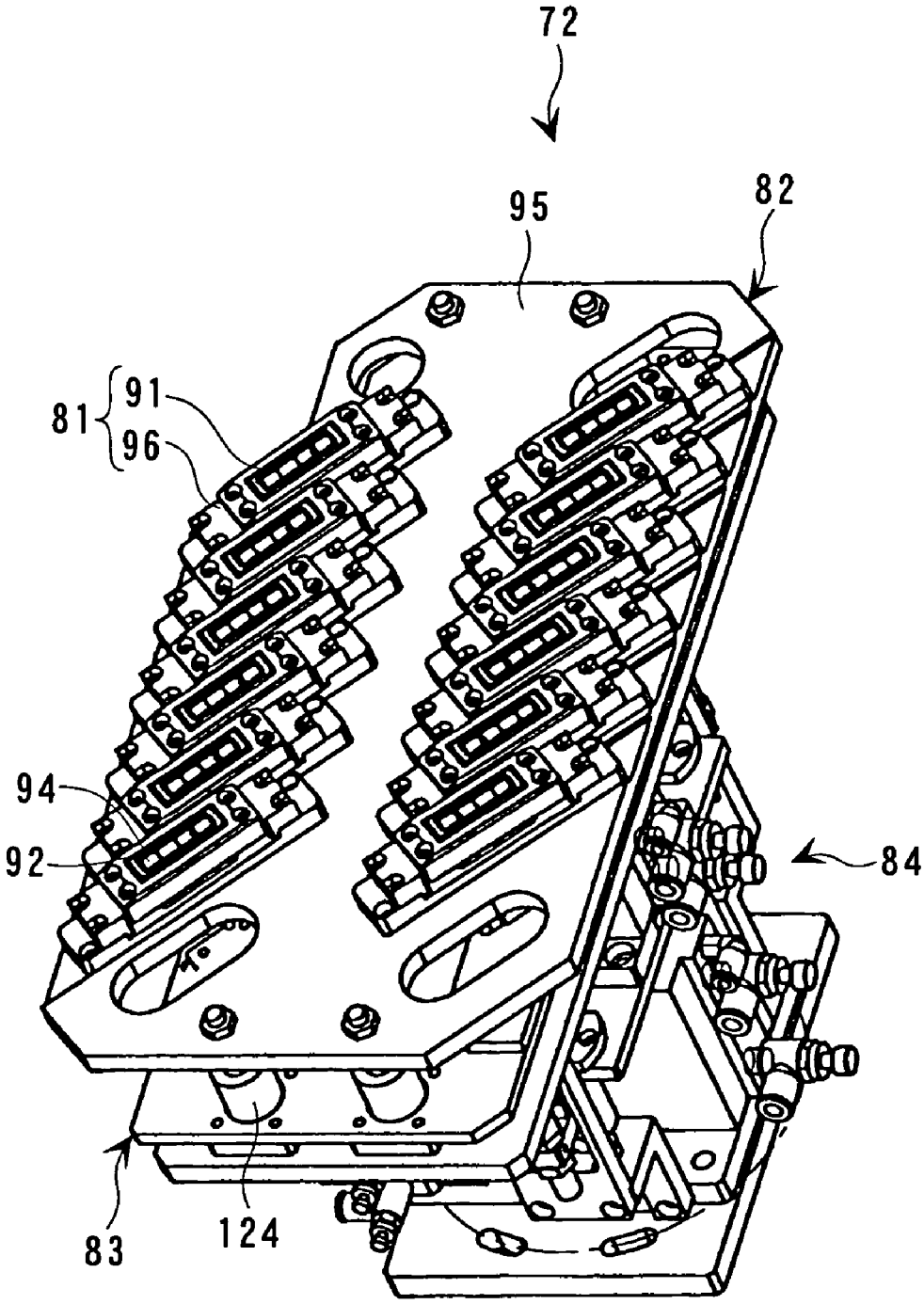
FIG. 7 is a perspective view thereof.
Figure 11:
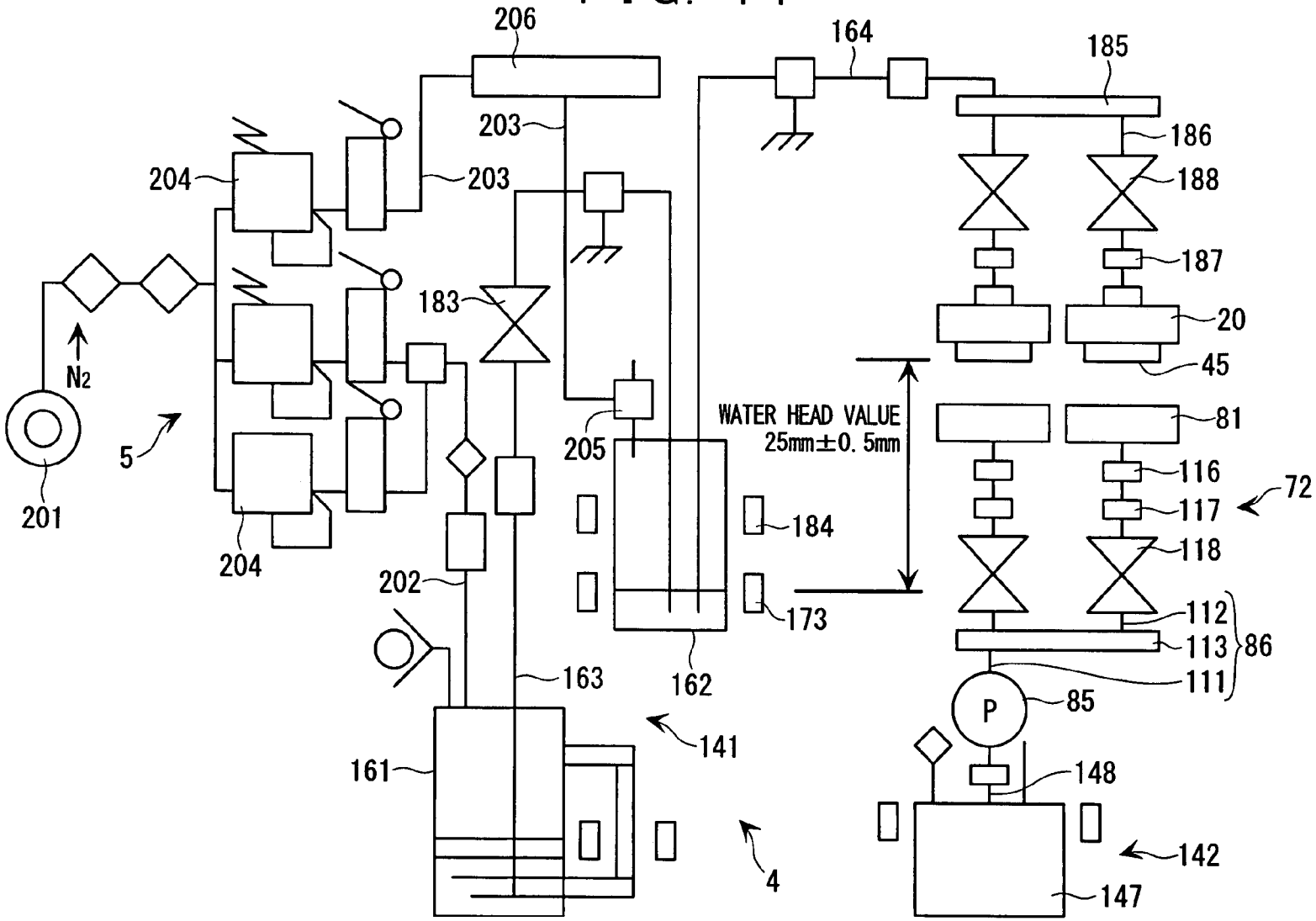
FIG. 11 is a piping diagram of the liquid droplet ejection head according to an embodiment of this invention.

The suction unit 72 is made up, as shown in FIGS. 7 and 11, of: a cap unit 82 which has assembled therein twelve caps 81 corresponding to the twelve liquid droplet ejection heads 20; a supporting member 83 which supports the cap unit 82; an elevating mechanism 84 which moves up and down the cap unit 82 through the supporting member 82; a suction pump 85 which sucks the function liquid through the caps 81; and a suction tube unit 86 which connects each of the caps 81 and the suction pump 85. The function liquid that has been sucked by the suction pump 85 is introduced into a reuse tank 147 from the suction tube unit 86 and the reuse tube 148.

Figure 9:
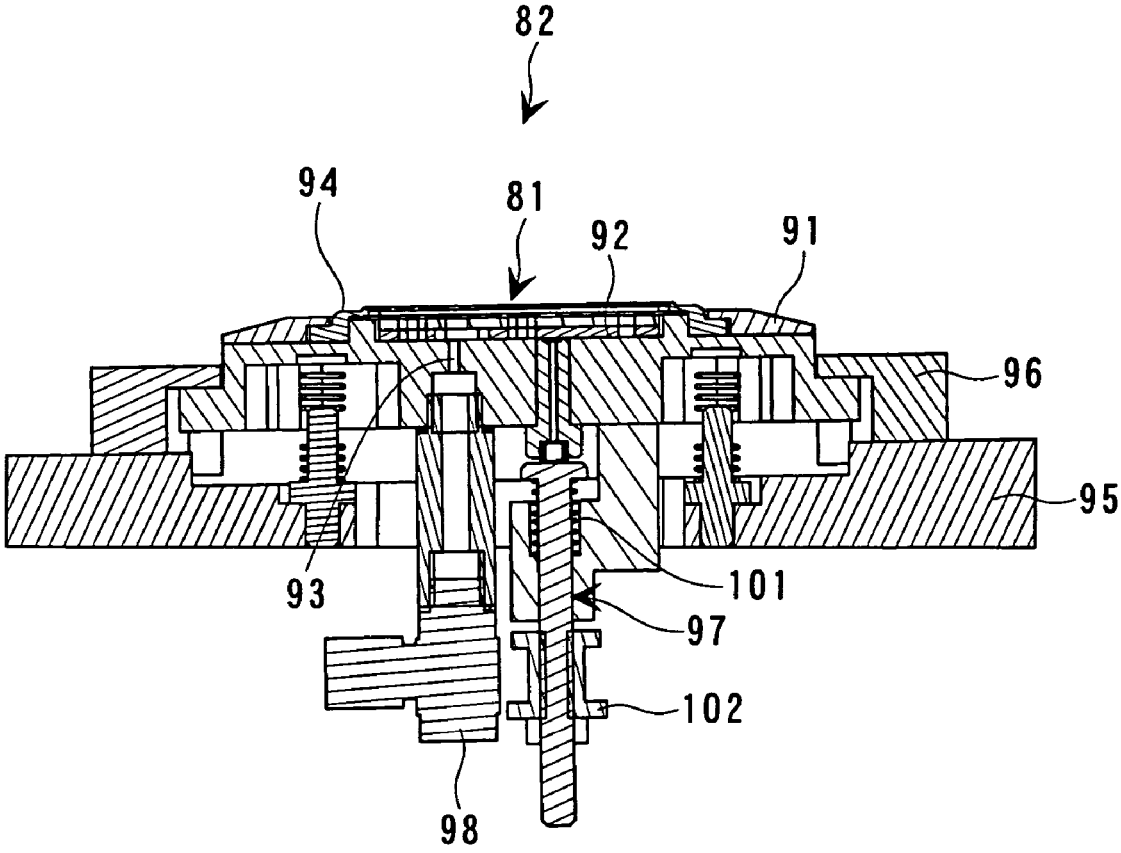
FIG. 9 is a sectional view of a cap of the suction unit according to an embodiment of this invention.

As shown in FIG. 9, each of the caps 81 is made up of: a cap main body 91; an absorbing material 92 which is laid on the bottom portion of the cap main body 91; a small hole 93 which is formed in the bottom portion of the cap main body 91; a sealing packing 94 which is attached to the upper peripheral portion of the cap main body 91; a cap holder 96 which fixes the cap main body 91 to the base plate 95; and a relief valve 97 which opens the cap main body 91 to atmosphere on its bottom side.

The sealing packing 94 is arranged to be capable of adhering to the peripheral portion of the nozzle surface 45 of the liquid droplet ejection heads 20 and seals it. The small hole 93 is in communication with an L-shaped coupling 98 and is connected to the suction tube unit 86. If the suction pump 85 is operated in a state in which the caps 81 are bought into close contact with the liquid droplet ejection heads 20 through the sealing packing 94, a negative pressure is operated on the liquid droplet ejection heads 20 through the small hole 93, or the like, and the function liquid is sucked from the liquid droplet ejection heads 20. The sucked function liquid is introduced from the absorbing material 92 to the reuse tank 147 through the suction tube unit 86, or the like.

The relief valve 97 is urged toward the upper closing side by a spring 101, and has an operating part 102 on the relief (open) side. The relief valve 97 opens against the spring 101 when the operating part 102 is lowered through an operating plate 125 (to be described hereinafter), whereby the cap main body 91 is opened to atmosphere from the bottom side. The opening of the relief valve 97 is effected against the spring 101 by lowering the operating part 102 by means of the operating plate 125, whereby the cap main body 91 is opened to atmosphere from the bottom side. The function liquid that has been impregnated into the absorbing material 92 is also sucked (details to be described hereinafter).

The suction tube unit 86 is made up, as shown in FIG. 11, of: a suction tube 111 which is connected to the suction pump 85; a plurality of (twelve) suction branch tubes 112 which are connected to the respective caps 81; a header pipe 113 which connects the suction tube 111 and the suction branch tubes 112. In other words, by means of the suction tube 111 and the suction branch tubes 112, there are formed flow passages which connect the caps 81 and the suction pump 85. Each of the suction branch tubes 112 has interposed therein, from the side of the caps 81 in sequence, a fluid sensor 116 which detects the presence or absence of the function liquid; a pressure sensor 117 which detects the pressure inside the suction branch tube 112; and a suction gate valve 118 which closes the suction branch tube 112.

Figure 8:
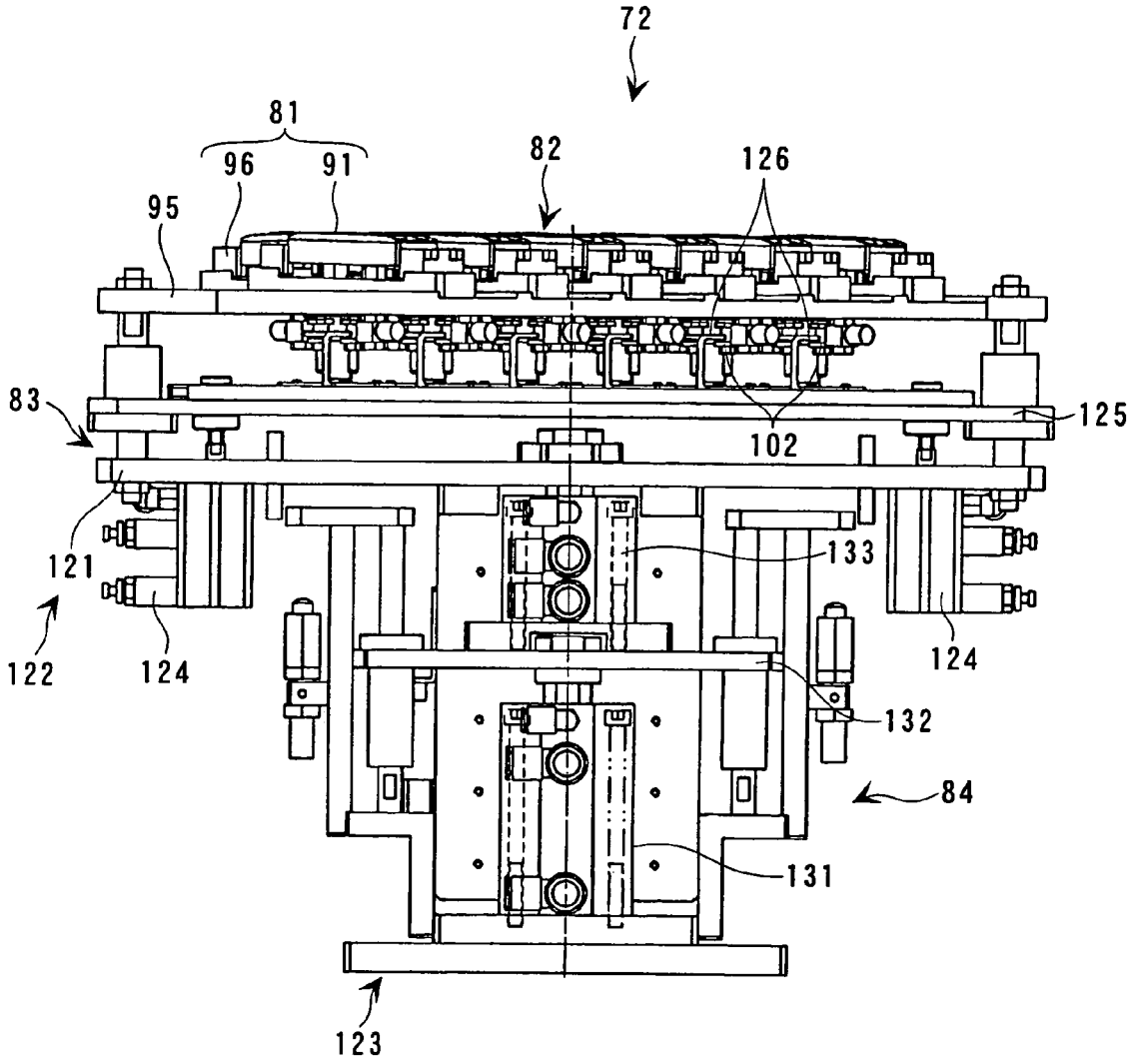
FIG. 8 is a front view thereof.

The supporting member 83 is made up, as shown in FIG. 8, of: a supporting member main body 122 which has a supporting plate 121 for supporting the cap units 82 on its upper end; and a stand 123 which supports the supporting member main body 122 in a manner to be slidable in the up and down direction. A pair of air cylinders 124 are fixed to both lower sides as seen in the longitudinal direction of the supporting plate 121. By means of the pair of air cylinders 124, the operation plate 125 is moved up and down. On the operation plate 125 is mounted a hook 126 which is engaged with the operating part 102 of the vent valve 97 in each of the caps 81. As a result of moving up and down of the operating plate 125, the hook 126 moves the operating part 102 up and down. The vent valve 97 is thus opened and closed.

The elevating mechanism 84 (mechanism for moving toward and away) is provided with two elevating cylinders 131, 133 each being made of air cylinders, i.e.: a lower-stage elevating cylinder 131 which is vertically disposed on the base portion of the stand 123; and an upper-stage elevating cylinder 133 which is vertically disposed on an elevating plate 132 which is moved up and down by the lower-stage elevating cylinder 131. A piston rod of the upper-stage elevating cylinder 133 is connected to the supporting plate 121. The strokes of both the elevating cylinders 131, 133 are different from each other. It is thus so arranged that, by the selective operation of both the elevating cylinders 131, 133, the elevated position of the cap unit 82 can be switched between a first position which is relatively high and a second position which is relatively low. When the cap unit 82 is in the first position, each of the caps 81 is brought into intimate contact with the liquid droplet ejection heads 20. When the cap unit 82 is in the second position, there will be generated a small clearance between each of the liquid droplet ejection heads 20 and each of the caps 81.

When the function liquid is sucked from the liquid droplet ejection heads 20, the suction unit 72 is moved by the moving table 17 to a predetermined position in the Y-axis direction, and also the liquid droplet ejection heads 20 are moved by the X/Y moving mechanism 23 into a position of the suction unit 72 after movement. The elevating mechanism 84 is then driven to move the cap unit 82 up to the first position. The caps 81 are thus brought into close contact with the nozzle surface 45 to thereby seal the liquid droplet ejection heads 20. By driving the suction pump 85 in this state, the suction of the function liquid is effected in a lump for all of the twelve liquid droplet ejection heads 20.

In the second position of the cap unit 82, the suction unit 72 can be functioned as a preliminary flushing box 71. As described hereinafter, the suction unit 72 can also be functioned as a function liquid receiver in the course of the initial filling of the function liquid into the liquid droplet ejection heads 20.

The wiping unit 73 is mounted, as shown in FIGS. 1, 3 and 4, on the common base 18 in close proximity to the suction unit 72. The wiping unit 73 is to wipe away by means of a wiping sheet (not illustrated) that nozzle surface 45 of each of the liquid droplet ejection heads 20 which has been stained due to adhesion of liquid droplet mists. This wiping work is basically performed after the suction processing of the liquid droplet ejection heads 20.

For example, when the cleaning (suction) of the liquid droplet ejection heads 20 has been completed, the wiping unit 73 is moved by the moving table 17 into a position facing the liquid droplet ejection heads 20. Then, the wiping unit 73 delivers (or rolls out) a rolled wiping sheet to thereby bring it into sliding contact with the nozzle surface 45 of the liquid droplet ejection heads 20. The wiping sheet after the wiping operation is taken up (or rolled in).

The liquid supply and recovery means 4 is made up, as shown in FIGS. 3 and 11, of: a function liquid supply system 141 which supplies each of the liquid droplet ejection heads 20 of the head unit 21 with the function liquid; and a function liquid recovery system 142 which recovers the function liquid that has been sucked by the suction unit 72. The function liquid recovery system 142 is made up, as shown in FIG. 11, of: a reuse tank 147 which stores the function liquid that has been sucked; and a recovery tube 148 which introduces the sucked liquid into the reuse tank 147. The reuse tank 147 is housed inside the larger housing chamber 14 together with the main tank 161 of the function liquid supply system 141, the waste liquid tank 149, or the like.

The function liquid supply system 141 is made up, as shown in FIG. 11, of: the main tank 161 which stores therein a large amount (3 liters) of function liquid; a liquid supply sub-tank 162 (function liquid storing part) which supplies each of the liquid droplet ejection heads 20 with the function liquid from the main tank 161; a first supply tube 163 which connects the main tank 161 and the liquid supply sub-tank 162; and a second supply tube 164 (supply passage) which connects the liquid supply sub-tank 162 and each of the liquid droplet ejection heads 20.

The main tank 161 sends under pressure the function liquid to be stored, into the liquid supply sub-tank 162 through the first supply tube 163 by means of the compressed air (inert gas) to be introduced from the air supply means 5. The function liquid stored in the liquid supply sub-tank 162 is supplied, under the influence of the pumping function (liquid ejection) of the liquid droplet ejection heads 20, into the liquid droplet ejection heads 20 through the second supply tube 164.

Figure 10:
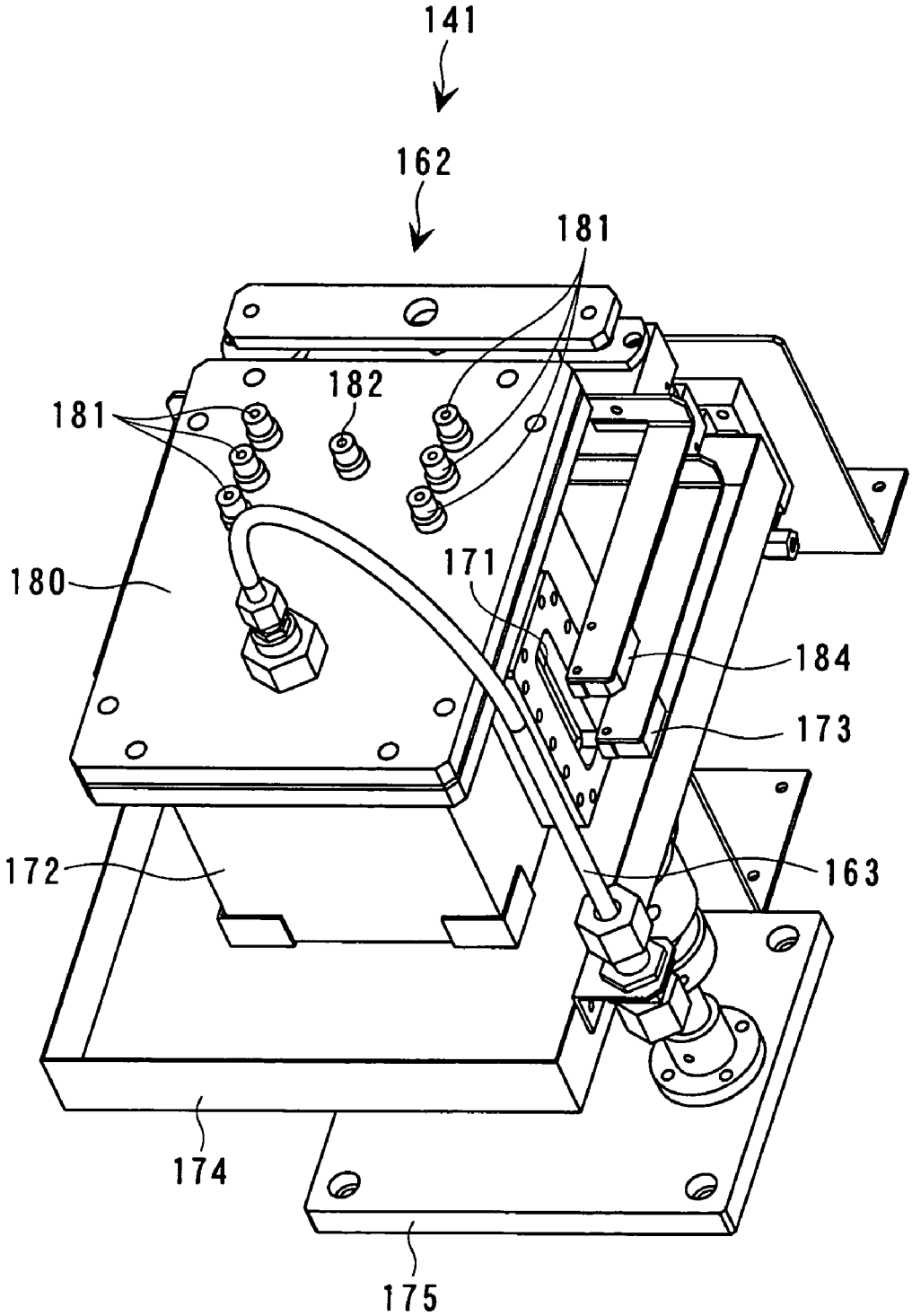
FIG. 10 is a perspective view of a liquid supply sub-tank according to an embodiment of this invention.

The liquid supply sub-tank 162 is fixed to the upper side of the tank base 16 of the machine base 12. As shown in FIG. 10, the liquid supply sub-tank 162 is made up of: a tank main body 172 which has peep holes (liquid level windows) 171 on both sides and which stores the function liquid; a level detector 173 which faces both the peep holes and which detects the liquid level (water level); a pan which mounts thereon the tank main body 172; and a tank stand 175 which supports the tank main body 172 through the pan 174.

A lid 180 which is located on an upper surface of the tank main body 172 is provided with: a first supply tube 163 which is connected to the lid 180; six liquid supply connectors 181 for the second supply tube 164; and a pressurizing connector 182 for a second air supply tube 203 (to be described hereinafter) which is connected to the air supply means 5. As shown in FIG. 11, the second air supply tube 203 has interposed therein a three-way valve 205 which has a relief port for opening to atmosphere. The tank main body 172 is thus arranged to be made free of the influence of the pressure from the air supply means 5. The first air supply tube 163, on the other hand, is provided with a liquid level adjusting valve 183 for adjusting the supply of the function liquid from the main tank 161.

The level detector 173 is disposed so as to maintain the difference in height between the nozzle surface 45 f the liquid droplet ejection heads 20 and the liquid level of the function liquid inside the tank main body 172 (i.e., the water head value) within a predetermined range (e.g., 25 mm±0.5 mm). In other words, depending on the result of detection by the level detector 173, the level adjusting valve 183 is appropriately controlled to be opened and closed (control using a timer) so that the liquid level of the function liquid staying in the tank main body 172 falls within a controlled range.

According to this arrangement, the liquid is prevented from dripping out of the nozzle 49 of the liquid droplet ejection heads 20. In addition, due to the pumping operation of the liquid droplet ejection heads 20, i.e., the pumping drive of the piezoelectric element inside the pump part 47, the liquid droplets are ejected at a high accuracy. Reference numeral 184 in FIG. 11 denotes an upper-limit detection sensor which detects the liquid level of the function liquid, in the similar manner as the liquid level detector 173. It is provided for the sake of safety in preparation for a wrong operation (detection error) of the liquid level detector 173.

As shown in FIGS. 10 and 11, the second supply tube 164 is connected at its one end to the liquid supply sub-tank 162 through the liquid supply connectors 181. The other end of the second supply tube 164 is branched through a T-shaped coupling 185 and is connected to the liquid droplet ejection heads 20 through the piping adaptors 51. In other words, the six second supply tubes 164 connected to the liquid supply sub-tank 162 are respectively divided into two through six T-shaped couplings 185 in order to cope with the twelve liquid droplet ejection heads 20, thereby forming a total of twelve second branch tubes 186. Each of the second branch tubes 186 is further divided into two before the liquid droplet ejection heads 20 and is connected to the two connection needles 41 of the liquid droplet ejection heads 20 through the two piping adaptors 51 (see FIGS. 5, 6A, 6B).

The second branch tubes 186 are provided, as seen from the side of the T-shaped coupling 185 in sequence, with: a supply valve 188 (gate valve) which closes the flow passage of the function liquid; and a liquid detection sensor 187 which detects the presence or absence of the function liquid. In order to minimize the length of the flow passage between the supply valve 188 and the liquid droplet ejection heads 20, the supply valve 188 is interposed in the second branch tube near the liquid droplet ejection heads 20. In concrete, the twelve supply valves 188, the six T-shaped couplings 185, or the like, are fixed, as an assembly, to the bridge plate 60 to which is fixed the main carriage 22 (see FIG. 1). The supply valves 188 are normally kept open and are closed at the time of initial filling of the function liquid (initial filling operation is described hereinafter). The liquid detection sensor 187 is used also mainly at the time of the initial filling of the function liquid.

The air supply means 5 has a function as a driving system air supply means which supplies the air to drive the elevating mechanism 84 of the suction unit 72, or the like. It also has a function as a pressurized liquid delivery means which supplies the main tank 161 and the liquid supply sub-tank 162 in the liquid supply and recovery means 4 with compressed air for delivering the function liquid under pressure.

As shown in FIG. 11, the air supply means 5 as the pressurized liquid delivery means is made up of: an air pump 201 (compressed air supply source) which supplies compressed air (gas) obtained by compressing inert gas such as nitrogen ($N_2$), or the like; a first air supply tube 202 which connects the air pump 201 and the main tank 161; and a second air supply tube 203 (pressurizing pipe) which connects the air pump 201 and the liquid supply sub-tank 162. The main tank 161 is pressurized by the compressed air flowing through the first air supply tube 202, and the liquid supply sub-tank 162 is pressurized by the compressed air flowing through the second air supply tube 203.

The first air supply tube 202 and the second air supply tube 203 have interposed therein regulators 204 which keep the pressure to a given constant pressure depending on where the compressed air is delivered. The second air supply tube 203 has further interposed therein a three-way valve 205 (pressuring-side gate valve) having a relief port (port which opens to atmosphere), and a pressure controller 206. The pressure controller 206 supplies the compressed air sent from the regulator 204 to the liquid supply sub-tank 162 after due pressure reduction and, by controlling to open and close the three-way valve 205, the pressurizing force to the liquid supply sub-tank 162 is made adjustable.

Although the details are described hereinafter, the compressed air is arranged to be capable of introduction into the liluid supply sub-tank 162 in addition to the main tank 161. The work of initial filling of the function liquid into the liquid droplet ejection heads 20 can thus be performed stably.

In place of the arrangement of this embodiment, the following arrangement may also be employed. Namely, the main tank 161 and the liquid supply sub-tank 162 are separately contained inside a pressurizing box (not illustrated) made of aluminum, or the like, and these tanks 161, 162 are independently pressurized through the pressurizing box. For example, by providing the liquid supply sub-tank 162 with ventilation holes, or the like, and this liquid supply sub-tank 162 is communicated with the inside of the pressurizing box so that the pressure inside the pressurizing box and the pressure inside the liquid supply sub-tank 162 is kept the same. Then, by supplying the pressurizing box with the compressed air from the air pump 201, the inside of the liquid supply sub-tank 162 can be pressurized.

The control means is provided with a control part which has a CPU and controls the operation of each stage. The control part stores therein the control program and the control data and also has a working region for performing the various control processing. The control means is connected to each of the above-described means and controls the entire liquid droplet ejection apparatus 1. The liquid droplet ejection apparatus 1 performs the imaging work, the initial filling work, or the like.

For example, when the imaging (or image-forming) work is performed on the workpiece W, the control means controls the respective ejection drive of the plurality of liquid droplet ejection heads 20, and also controls the relative moving operations of the workpiece W and the head unit 21 by means of the X/Y moving mechanism 23. During the imaging work, the liquid supply and recovery means 4 and the air supply means 5 are controlled. The liquid level control of the function liquid inside the liquid supply sub-tank 162 is made basically in a state of being opened to atmosphere. By means of the suction unit 72 and the wiping unit 73 of the maintenance means 3, the suction processing and the wiping processing are performed on the liquid droplet ejection heads 20.

A description will now be made about the filling operation to fill the flow passages inside the liquid droplet ejection heads 20 with the function liquid (also referred to as an initial filling work) with reference to an embodiment in FIG. 11 by means of the control means.

The initial filling work is performed not only when the liquid droplet ejection heads 20 are newly installed, but also when the liquid droplet ejection heads are newly introduced as a result of replacement, or the like. In such a case, since the flow passages inside the liquid droplet ejection heads 20 are empty, it is necessary to forcibly send the function liquid from the liquid supply sub-tank 162 instead of by the pumping operation of the liquid droplet ejection heads 20. In addition, in order to prevent the poor ejection of the liquid droplet ejection heads 20, the air bubbles in the flow passages inside the liquid droplet ejection heads must have been completely removed at the end.

Therefore, in the initial filling operation of this embodiment, the function liquid is forcibly sent to the liquid droplet ejection heads 20 by using the above-described pressurized liquid supply means 5 (air supply means). Then, by using the suction unit 72, the liquid droplet ejection heads 20 are subjected to sucking. In other words, the function liquid filling apparatus for the liquid droplet ejection heads of this invention is constituted mainly by the pressurized liquid supply means 5 and the suction unit 72. The initial filling is performed by moving the liquid droplet ejection heads 20 (head unit 21) to a position right above the suction unit 72. The pressurized feeding of the function liquid is performed in a state in which the cap unit 82 is moved up to the second position. The suction of the function liquid is performed in a state in which the cap unit 82 is moved up to the first position and in which the caps 81 are held in close contact with the liquid droplet ejection heads 20.

Figure 12:
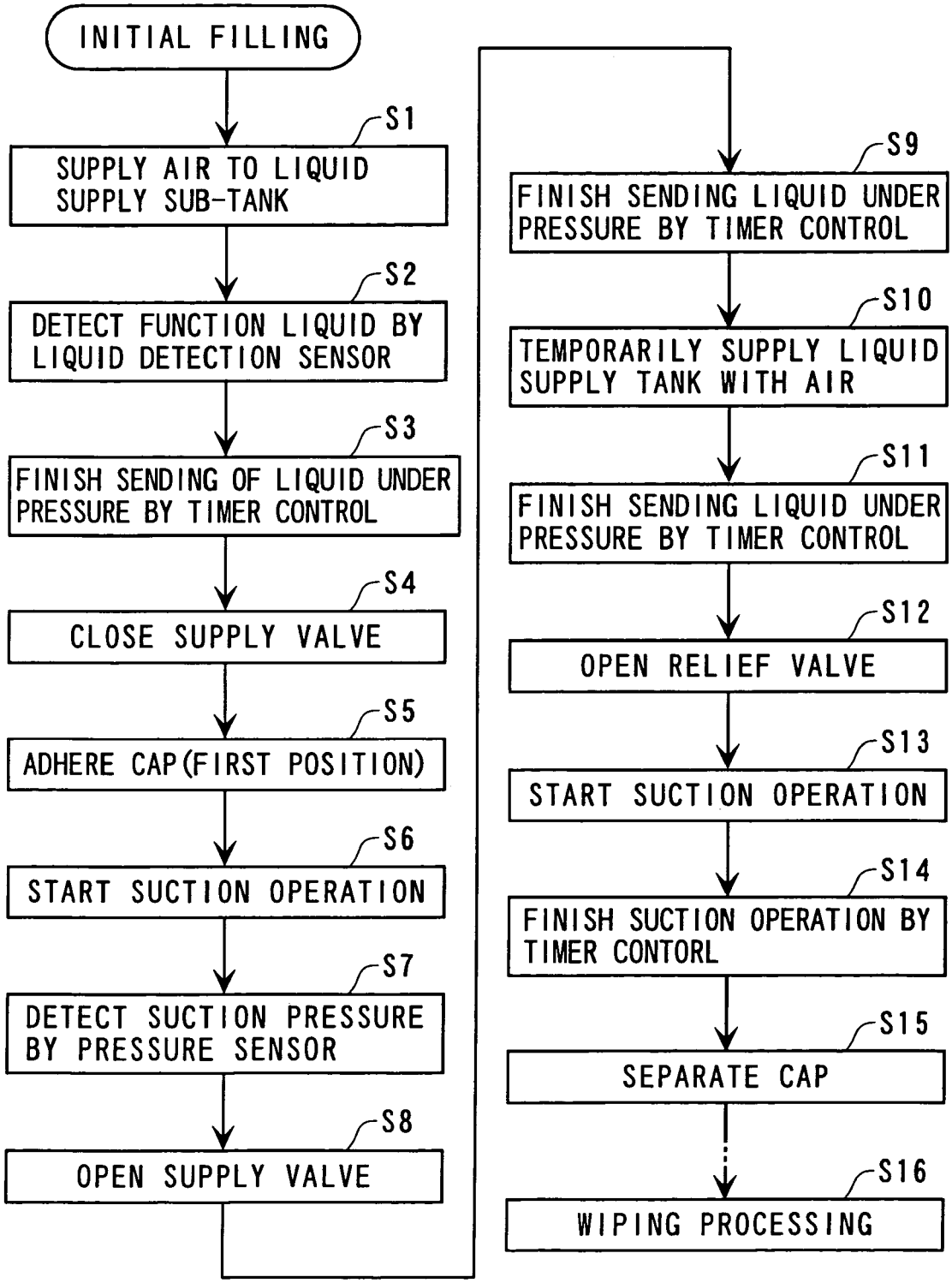
FIG. 12 is a flow chart showing the process of filling the liquid droplet ejection head with a function liquid.

FIG. 12 is a flow chart showing an outline of the processing flow of the initial filling work. First, as shown in FIGS. 11 and 12, at step S1, the pressurized liquid supply means 5 is driven. Namely, by switching the three-way valve 205, the closing of the second air supply tube 203 is left open so that the compressed air can be supplied from the air pump 201 to the liquid supply sub-tank 162. According to this operation, the function liquid in the liquid supply sub-tank 162 is sent under pressure to the liquid droplet ejection heads 20 through the second supply tube 164 and the second branch tubes 186. At this time, in order to prevent the air bubbles from being generated in the function liquid, the function liquid shall preferably be fed under pressure at a relatively small flow velocity of 50 mm/sec or less in the second supply tube 164, or the like.

If the function liquid is detected by the liquid detection sensor 187 (step S2), the function liquid detection signal is transmitted to the control means. The feeding or sending of the function liquid under pressure is finished as a result of control by a timer (step S3). In concrete, after the function liquid is detected, the flow passages inside the function liquid ejection heads 20 are filled with the function liquid. When sufficient time has passed for the function liquid to ooze or flow out of the nozzles 49 of the liquid droplet ejection heads 20, the three-way valve 205 is switched to the relief port to thereby close the second air supply tube 203, and also the pressure inside the liquid supply sub-tank 162 is discharged into atmosphere. The function liquid which oozes (or which is discharged) out of the liquid droplet ejection heads 20 is received by the caps 81 in the second position without allowing it to be spread outside.

In the next timing in which the operation to feed the liquid under pressure (driving of the pressurized liquid supply means 5) is stopped, the supply valve 188 is closed to thereby block the second branch tubes 186 (step S4). The elevating mechanism 84 is driven to thereby move the caps 81 to the first position, thereby bringing the caps 81 into close contact with the liquid droplet ejection heads 20 (step S5). Then, the suction gate valve 118 is opened and the suction pump 85 is driven to thereby start the suction operation (step S6). According to these operations, the liquid droplet ejection heads 20 are subjected to the negative pressure through the caps 81, whereby the function liquid is sucked from the liquid droplet ejection heads 20. At this time, the air bubbles that could be staying in the flow passages inside the liquid droplet ejection heads are expanded as a result of pressure decrease effect (80 kPa or less) due to suction and are discharged through the nozzles 49 together with the function liquid.

In concrete, even if the air bubbles stay in the flow passages inside the liquid droplet ejection heads at the point of time of completion of step 3, the air bubbles will be expanded in the flow passages inside the liquid droplet ejection heads due to pressure decrease effect by the time when the pressure sensor 117 detects a predetermined pressure (i.e., the pressure below 80 kPa) due to the suction operation (step S7). Then, the control means to which is transmitted the pressure detection signal by the pressure detector 117 opens the supply valve 188 which is in the closed state to thereby open the second branch tubes 186. Due to the suction operation which is being continued, the function liquid and the remaining or residual air bubbles are sucked and discharged from the flow passages inside the liquid droplet ejection heads toward the nozzles 49 (step S8). At this time, when the function liquid is sucked at a relatively high velocity of 1000 mm/sec or less, the residual air bubbles can be appropriately discharged.

As a result of control with a timer by means of the control means, the suction gate valve 118 is closed to thereby finish the suction operation (step S9). The filling of the flow passages inside the liquid droplet ejection heads with the function liquid is thus completed.

In the initial filling operation, the positive pressure by the pressurized liquid supply means 5 is employed first. Therefore, the function liquid can be supplied to the liquid droplet ejection heads 20 while keeping the generation of the air bubbles to the smallest extent possible. Then, by finally employing the negative pressure by the suction unit 72, the residual air bubbles in the flow passages inside the liquid droplet ejection head can be enlarged or expanded due to the pressure reduction effect. The residual air bubbles and the function liquid can thus be adequately and surely discharged from the nozzles 49 of the liquid droplet ejection heads 20.

Alternatively, the caps 81 may be moved to the first position already at the time of step S1 to thereby bring the caps 81 into intimate contact with the liquid droplet ejection heads 20, whereby the step S5 may be omitted. In addition, during the suction operation (i.e., between the step S8 and step S9), the supply valve 188 may be opened and closed several times. According to this operation, there will temporarily occur pulsation in the flow passages inside the liquid droplet ejection heads. Therefore, even the air bubbles sticking to the flow passages inside the liquid droplet ejection heads can be discharged well.

Due to the difference in the flow resistances in the function liquid flow passages, the filling time may vary with the plurality of liquid droplet ejection heads 20. In such a case, in the processing between the step S2 and the step S4, the supply valve 188 is controlled to be closed for each of the liquid flow detection sensors 187. In this manner, the function liquid need not be wastefully oozed from the liquid droplet ejection heads 20 that have been filled with the function liquid. In other words, if the supply valves 188 are closed in the order in which the function liquid reaches the respective liquid detection sensors 87, the amount of consumption of the function liquid can be reduced.

The steps after the step S10 show the subsequent flow until the liquid droplet ejection heads 20 are subjected to the wiping processing. At steps S10 and S11, the three-way valve 205 is switched in the same manner as at step S1 to thereby supply the liquid supply sub-tank 162 with compressed air. Under control using timer by the control means, the function liquid is sent under pressure to the liquid droplet ejection heads 20. As a result of this temporary liquid supply operation under pressure, the meniscus of the function liquid at the liquid droplet ejection heads 20 becomes stable.

Then, the relief valve 97 (see FIG. 9) in each of the caps 81 is opened (step S12) to thereby open the suction gate valve 118. Also, the suction pump 85 is driven to thereby perform the suction operation (step S13). Under control using timer by the control means, the suction gate valve 118 is closed to thereby finish the suction operation (step S14). According to these operations, even if the caps 81 are in a state of being in close contact with the liquid droplet ejection heads 20, the bottom side is open to atmosphere as a result of opening of the relief valve 97. Therefore, the function liquid impregnated in the absorbing material 92 in each of the caps 81 is adequately sucked without affecting the meniscus of the function liquid in the liquid droplet ejection heads 20.

Thereafter, the caps 81 are separated from the liquid droplet ejection heads 20 (step S15), and the liquid droplet ejection heads 20 (head unit 21) are moved to a position right above the wiping unit 73 to thereby perform the wiping processing (step S16). As a result of the wiping processing, the nozzle surface 45 of the liquid droplet ejection heads 20 stained by the function liquid at the time of filling thereof can be wiped away so that the liquid droplet ejection heads 20 become a state of waiting for the imaging operation.

A description will now be made about another embodiment of initial filling. Although not illustrated separately, the difference between the first embodiment and the second embodiment is described with reference to FIG. 12. The liquid supply under pressure at step S3 is not finished but the steps S4 through S7 are continued in a state of continuing the liquid supply under pressure. According to these operations, by opening the supply valve 188 at step S8, the function liquid can be quickly discharged together with the residual air bubbles out of the flow passages inside the liquid droplet ejection heads, as a result of combined effect of the operation of liquid supply under pressure and the suction operation. In addition, since the operation of liquid supply under pressure is being continued even after the completion of the step S9, the steps S10 and S11 can also be performed quickly.

In case the caps 81 are not equipped with the vent valves 97, the residual air bubbles once discharged to the caps 81 may sometimes flow back to the liquid droplet ejection heads 20 while the cap 81 are separated therefrom.

Then, in the third embodiment, the cap 81 is separated right before the completion of the suction operation at the step S9. In other words, while performing the suction drive at the final stage, the caps 81 are separated from the liquid droplet ejection heads 20. In this manner, the residual air bubbles can be appropriately prevented from flowing backward at the time of releasing the caps 81 from the state of being in intimate contact with the liquid droplet ejection heads 20. After having performed the steps S10 and S11, the suction driving is performed (by canceling the step S12). The caps 81 whose upper side has already been opened to atmosphere as a result of moving away of the liquid droplet ejection heads 20 allow the function liquid to be sucked from their absorbing materials 92. The liquid droplet ejection heads 20 subsequently move to the wiping processing (step S15 is canceled).

A description will now be made about a construction (structure) of, and a method of manufacturing, an electrooptic device (flat panel display) which is manufactured by using the liquid droplet ejection apparatus 1 of this invention. As examples of the electrooptic device, a color filter, a liquid crystal display device, an organic electroluminescence (EL) device, a plasma display panel (PDP) device, an electron emission device (field emission display (FED) device, a surface conduction electron emitter (SED) display), or the like, can be listed. Further, a description will be made about a method of manufacturing an active matrix substrate or the like, as an example, which is formed on the above-described devices. The active matrix substrate is a substrate on which a thin film transistor, as well as source lines and data lines for electrical connection to the thin film transistor are formed.

Figure 13:
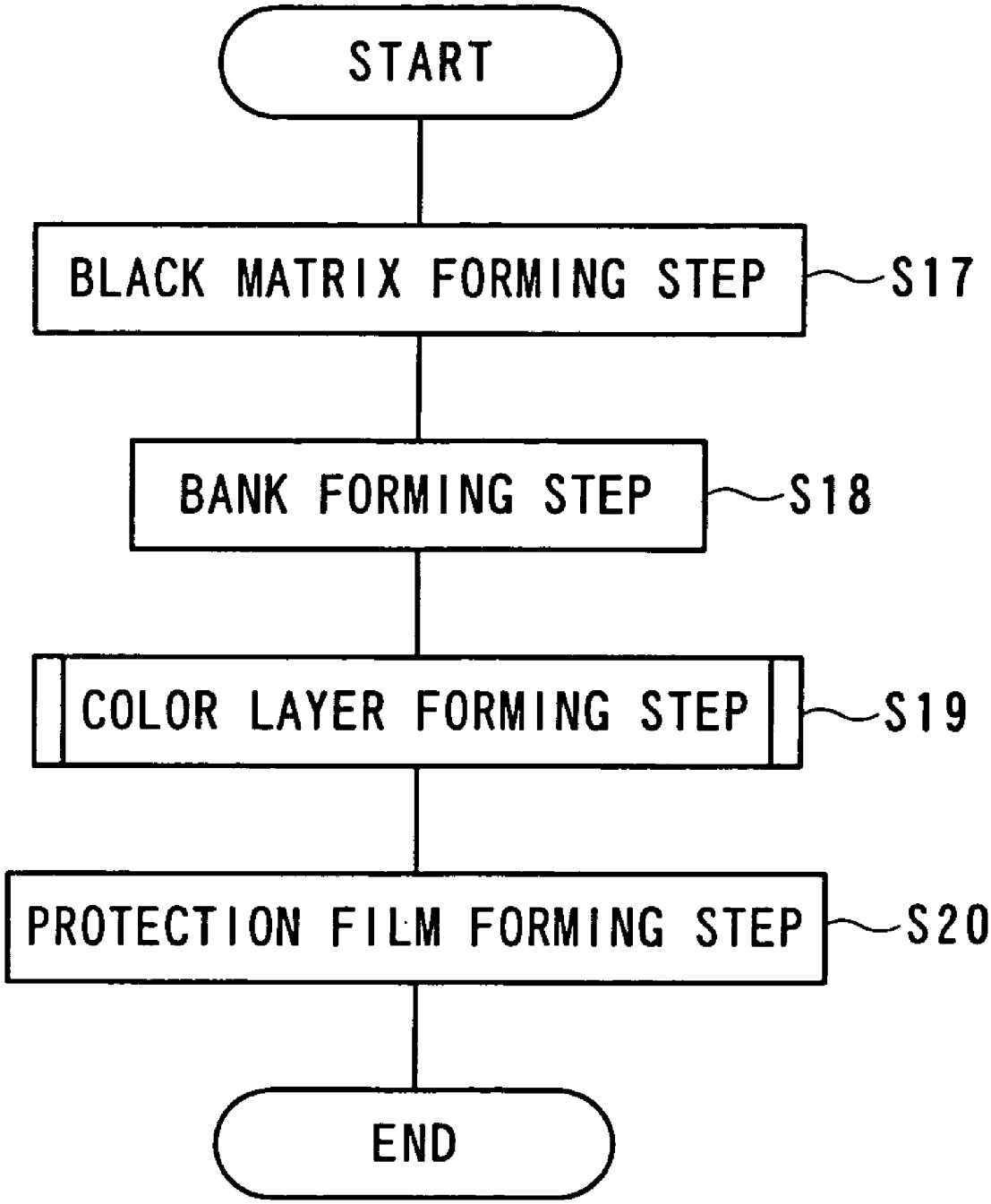
FIG. 13 is a flow chart showing the step of manufacturing a color filter.

First, an explanation will be made about the method of manufacturing a color filter which is built or assembled in a liquid crystal display device, an organic EL device, or the like. FIG. 13 is a flow chart showing the manufacturing steps of the color filter, and FIGS. 14A through 14E are schematic cross-sectional views showing the color filter 500 (filter base member 500A) of this embodiment, as shown in the order of manufacturing steps.

Figure 14A:
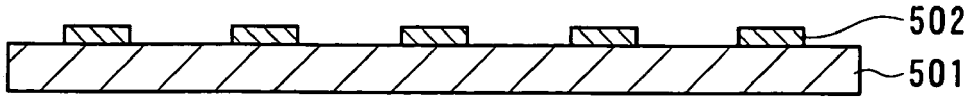
FIGS. 14A through 14E are schematic sectional views of the color filter as shown in the order of manufacturing steps.

First, at the black matrix forming step (S17), as shown in FIG. 14A, a black matrix 502 is formed on a substrate (W) 501. The black matrix 502 is formed of metallic chrome, a laminated member of metallic chrome and chrome oxide, or of resin black, or the like. In order to form the black matrix 502 made of a metallic thin film, a sputtering method, vapor deposition method, or the like, may be used. In addition, in case the black matrix 502 made of a resin thin film is formed, a gravure printing method, photo-resist method, thermal transfer method, or the like, may be used.

Figure 14B:
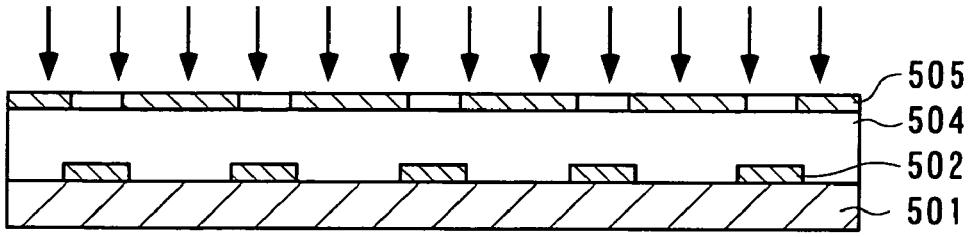

Then, at a bank forming step (S18), a bank 503 is formed in a state of being superposed on the black matrix 502. In other words, as shown in FIG. 14B, there is formed a resist layer 504 which is made of a negative type of transparent photosensitive resin so as to cover the substrate 501 and the black matrix 502. Then, the upper surface thereof is subjected to exposure processing in a state of being coated with a mask film 505 which is formed in a shape of a matrix pattern.

Figure 14C:
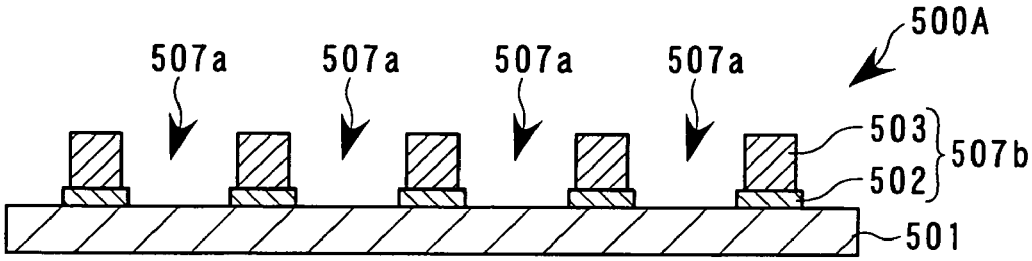

As shown in FIG. 14C, the un-exposed portion of the resist layer 504 is subjected to etching processing to perform patterning of the resist layer 504, whereby a bank 503 is formed. In case the black matrix is formed by the resin black, it becomes possible to commonly use the black matrix and the bank.

The bank 503 and the black matrix 502 thereunder become a partition wall portion 507*b* which partitions each of pixel regions 507*a*, thereby defining a shooting or firing region by the function liquid droplet (i.e., a region in which the function liquid droplet hits the target) at the subsequent color layer forming step to form the color layers (film forming layers) 508R, 508G, 508B.

By performing the above-described black matrix forming step and the bank forming step, the above-described filter base member 500A can be obtained.

As the material for the bank 503, there is used in this embodiment a resin material whose surface of coated film becomes liquid-repellent (water-repellent). Since the surface of the substrate (glass substrate) 501 has a liquid-affinity (affinity to water), the accuracy of shooting the liquid droplet into each of the pixel regions 507*a* enclosed by the bank 503 (partition wall portion 507*b*) is improved at a color layer forming step which is described hereinafter.

Figure 14D:
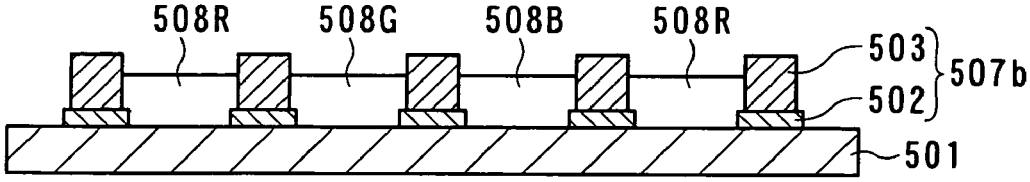

Then, at a color layer forming step (S19), as shown in FIG. 14D, the function liquid droplet is ejected by the function liquid droplet ejection head 20 to thereby cause the liquid droplet to be shot or fired into each of the pixel regions 507*a* enclosed by the partition wall portion 507*b*. In this case, by using the liquid droplet ejection heads 26, three colors of red (R), green (G), and blue (B) function liquids (filter materials) are respectively introduced to thereby eject the function liquid droplets.

Figure 14E:
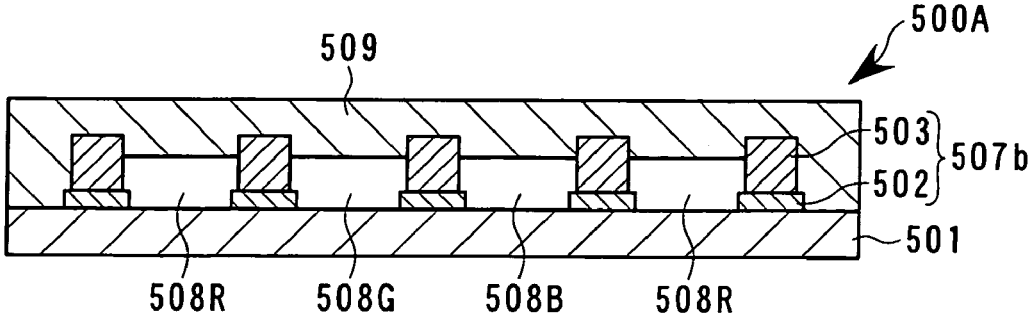

Thereafter, after drying processing (processing of heating, or the like), the function liquid is caused to be fixed to thereby form color layers 508R, 508G, 508B of three colors. Once the color layers have been formed, the step transfers to a protection film forming step (S20). As shown in FIG. 14E, a protection film 509 is formed to cover the upper surfaces of the substrate 501, the partition wall portion 507*b*, and color layers 508R, 508G, 508B.

In other words, after having ejected the protection film coating liquid over that entire surface of the substrate 501 on which the color layers 508R, 508B, 508G are formed, the protection film 509 is formed through the drying step.

After having formed the protection film 509, the color filter transfers to a subsequent film-forming step at which a film such as indium tin oxide (ITO) to form a transparent electrode at the next step is formed. substrate 501 is cut into respective effective pixel regions to thereby obtain the color filter 500.

Figure 15:
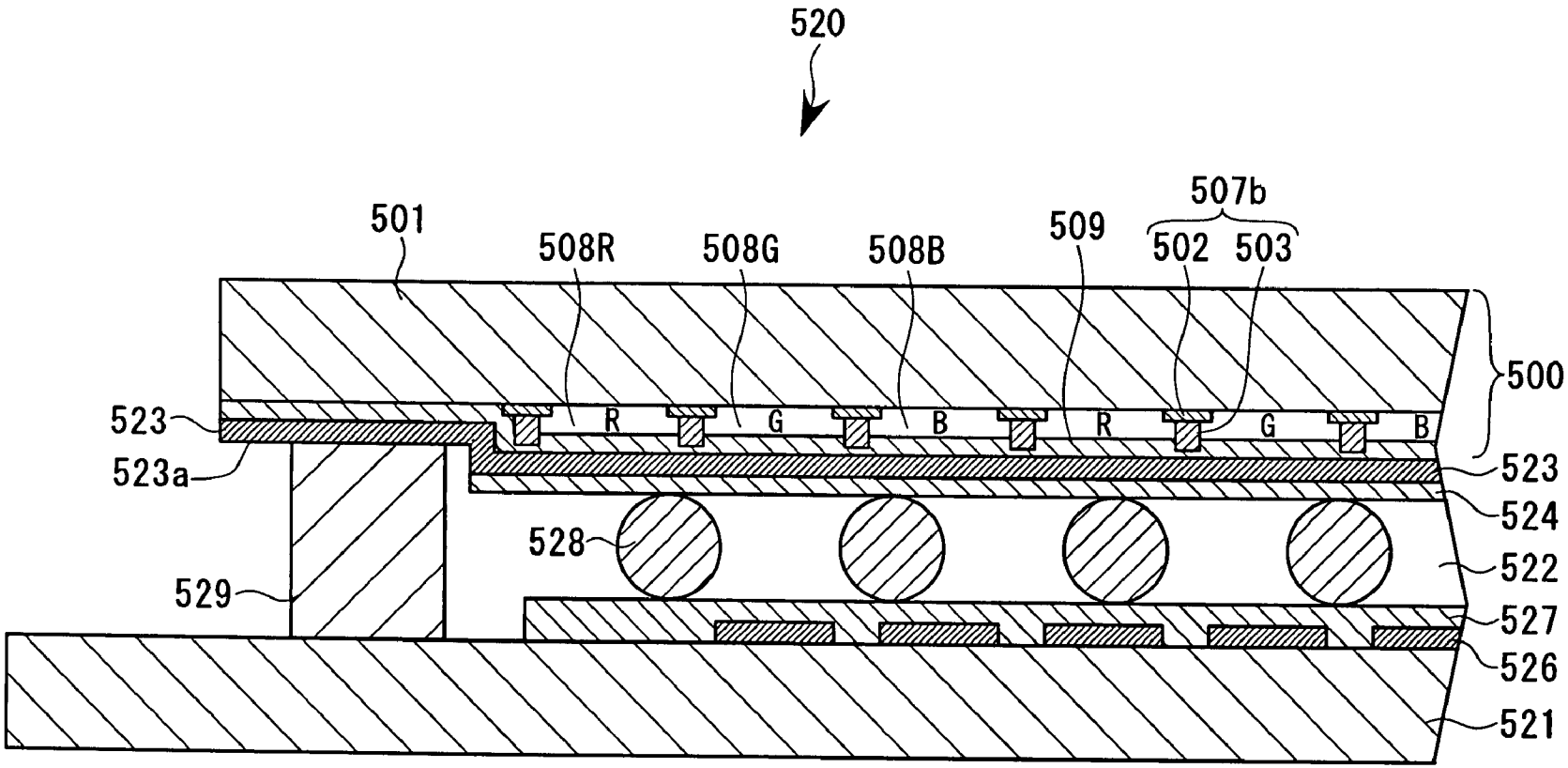
FIG. 15 is a sectional view of an important portion showing a general construction of a liquid crystal device using the filter to which this invention is applied.

FIG. 15 is a sectional view of an important portion showing a general structure of passive matrix type of liquid crystal device (liquid crystal device) as an example of a liquid crystal display device employing the above-described color filter 500. By mounting auxiliary elements such as a liquid crystal driving integrated circuit (IC), backlight, supporting member, or the like, on this liquid crystal device 520, there is obtained a transmission liquid crystal display device as a final product. The color filter 500 is the same as that shown in FIGS. 14A through 14E. Therefore, the same reference numerals are affixed to the corresponding parts/portions and the explanation thereabout is omitted.

This liquid crystal device 520 is made up substantially of: a color filter 500; an opposite substrate 521 made of a glass substrate, or the like; and a liquid crystal layer 522 which is made up of a super twisted nematic (STN) liquid crystal composition interposed therebetween. The color filter 500 is disposed on an upper side as seen in the figure (i.e., on a side from which the viewer looks at the color filter).

Although not illustrated, on an outside surface of the opposite substrate 521 and of the color filter 500 (i.e., the surface which is opposite to the liquid crystal layer 522), there is respectively disposed a polarizer. On an outside of the polarizer which is positioned on the side of the opposite electrode 521, there is disposed a backlight.

On the protection film 509 (on the side of the liquid crystal) of the color filter 500, there are disposed a plurality of rectangular first electrodes 523 which are elongated in the left and right direction as seen in FIG. 15. A first alignment layer 524 is formed so as to cover that side of the first electrode 523 which is opposite to the color filter 500.

On that surface of the opposite substrate 521 which lies opposite to the color filter 500, a plurality of second electrodes 526 are formed at a given distance to one another in a direction at right angles to the first electrode 523 of the color filter 500. A second alignment layer 527 is formed so as to cover that surface of the second electrode 526 which is on the side of the liquid crystal layer 522. The first electrode 523 and the second electrode 526 are formed by a transparent conductive material such as ITO, or the like.

The spacer 528 which is provided inside the liquid crystal layer 522 is a material to keep the thickness of the liquid crystal layer 522 (cell gap) constant. The sealing material 529 is a material to prevent the liquid crystal composition inside the liquid crystal layer 522 from leaking outside. One end of the first electrode 523 is extended to the outside of the sealing material 529 as a running cable 523*a*.

The crossing portions between the first electrode 523 and the second electrode 526 form the pixels. It is thus so arranged that the color layers 508R, 508G, 508B of the color filter 500 are positioned in these portions which form the pixels.

At the ordinary manufacturing steps, the color filter 500 is coated with the patterning of the first electrode 523 and the first alignment layer 524, to thereby form the portion on the side of the color filter 500. Aside from the above, the opposite substrate 521 is coated with the patterning of the second electrode 526 and the second alignment layer 527, to thereby form the portion on the side of the opposite substrate 521. Thereafter, the spacer 528 and the sealing material 529 are formed into the portion on the side of the opposite substrate 521, and the portion on the side of the color filter 500 is adhered to the above-described portion in that state. Then, the liquid crystal which forms the liquid crystal layer 522 is filled from an inlet port of the sealing material 529, and the inlet port is closed thereafter. Then, both the polarizers and the backlight are laminated.

In the liquid droplet ejection apparatus 2 of this embodiment, the spacer material (function liquid) which forms, e.g., the cell gap is coated. Further, before the portion on the side of the color filter 500 is adhered to the portion on the side of the opposite substrate 521, the liquid crystal (function liquid) is uniformly coated on the region enclosed by the sealing material 529. In addition, the coating of both the first and second alignment layers 524, 527 may alternatively be performed by the function liquid droplet ejection heads 26.

Figure 16:
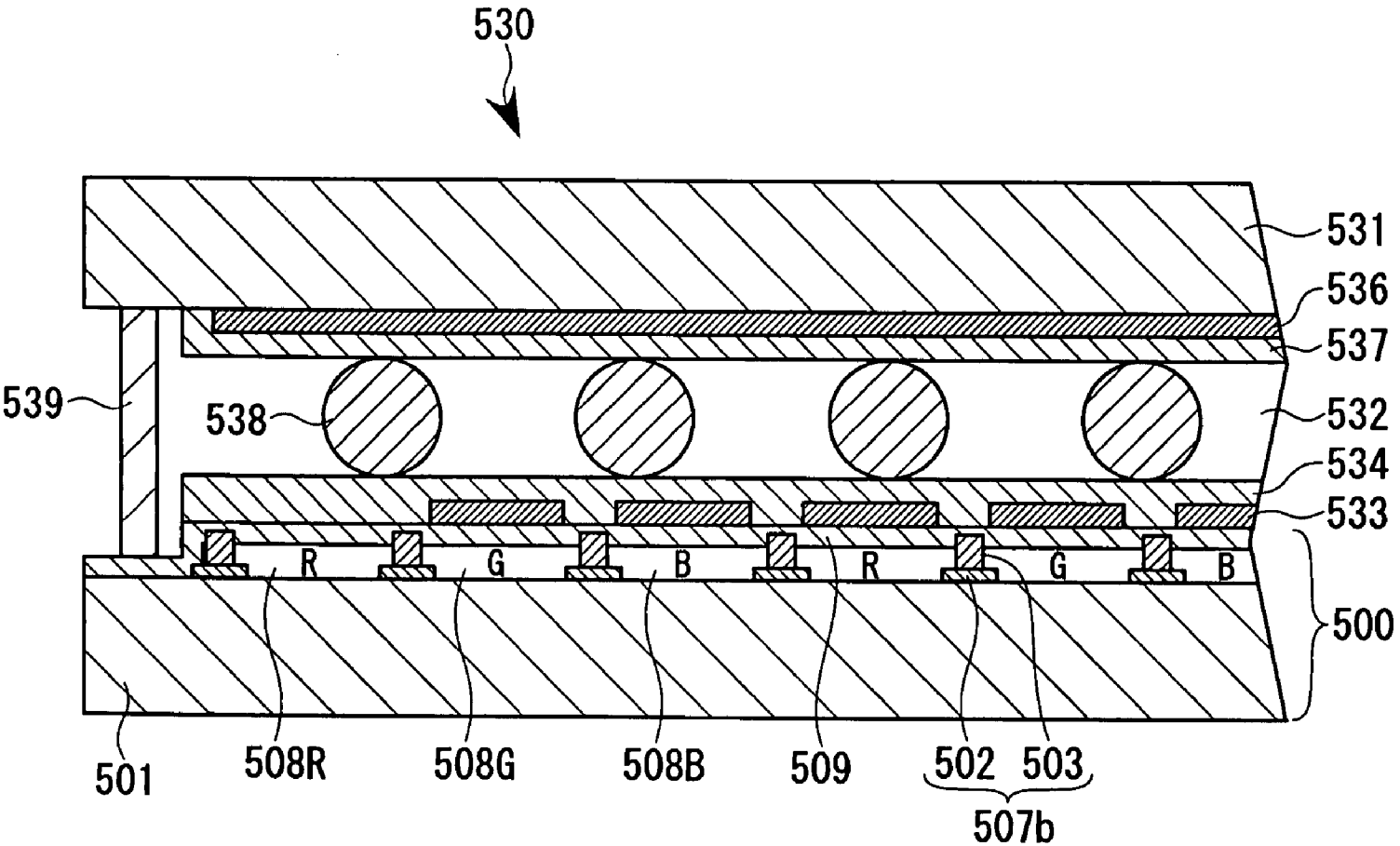
FIG. 16 is a sectional view of an important portion showing a general construction of a liquid crystal device of a second embodiment using the filter to which this invention is applied.

FIG. 16 is a sectional view of an important portion showing a general structure of a liquid crystal device using a color filter 500 manufactured in this embodiment.

What this liquid crystal device 530 is largely different from the above-described liquid crystal device 520 is that the color filter 500 is disposed on the lower side as seen in the figure (i.e., on the side opposite to the side from which the viewer looks at the device).

This liquid crystal device 530 is constructed such that a liquid crystal layer 532 which is made of an STN liquid crystal is sandwiched between the color filter 500 and the opposite substrate 531 which is made of a glass substrate, or the like. Though not illustrated, a polarizer, or the like, is disposed on an outside surface of the opposite substrate 531 and the color filter 500, respectively.

Figure 26:
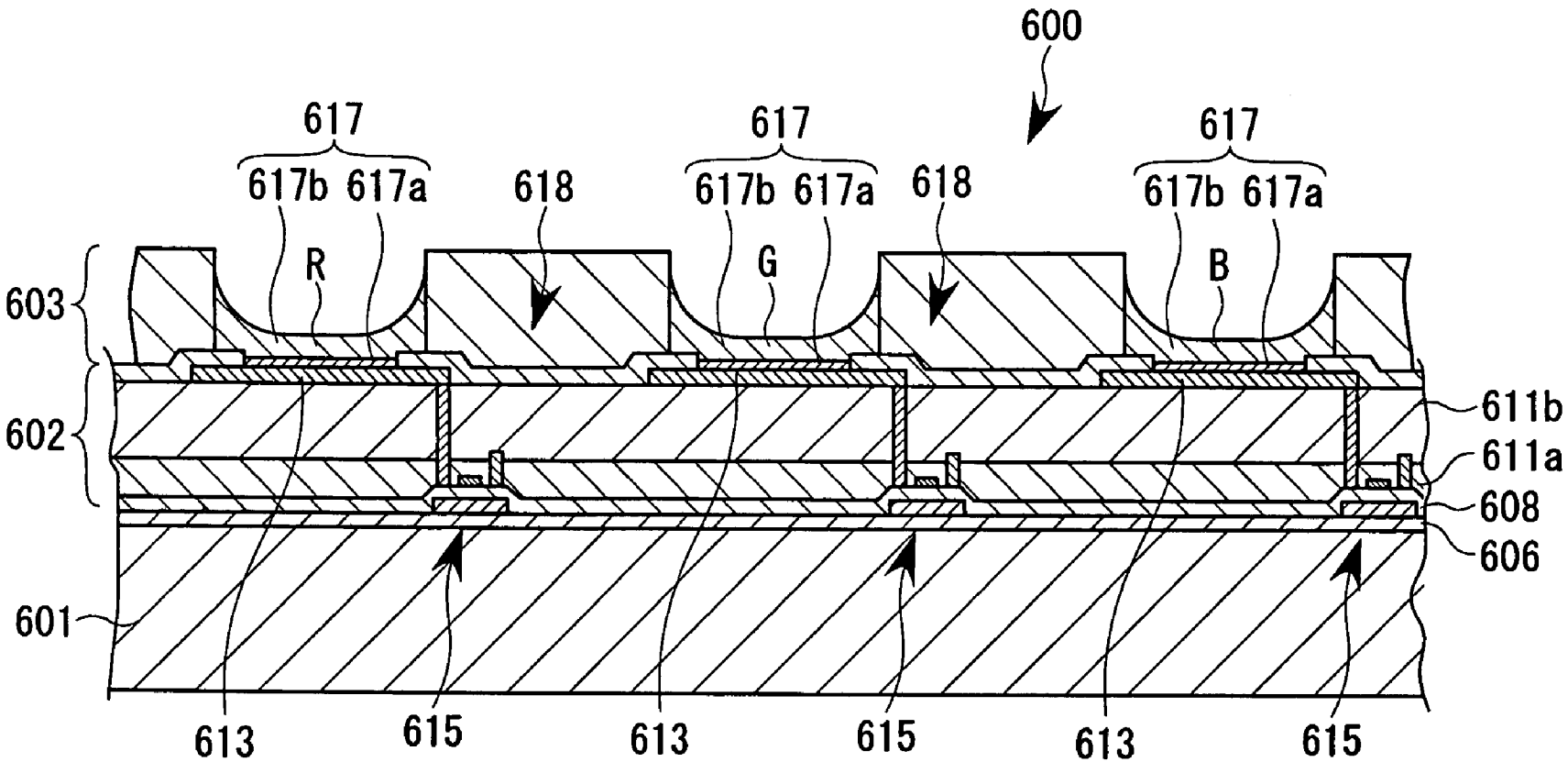
FIG. 26 is a schematic diagram showing the state in which the emitting layer of each color has been formed.

On the protection film 509 (on the side of the liquid crystal layer 532) of the color filter 500, there are formed a plurality of rectangular first electrodes 533 which are elongated in a direction at right angles to the surface plane of FIG. 26. A first alignment layer 534 is formed so as to cover that side of the first electrode 533 which is on the side of the liquid crystal layer 532.

On that surface of the opposite substrate 531 which lies opposite to the color filter 500, a plurality of second electrodes 536 are formed at a given distance to one another in a direction at right angles to the first electrode 533. A second alignment layer 537 is formed so as to cover that surface of the second electrode 536 which is on the side of the liquid crystal layer 532.

The liquid crystal layer 532 is provided with a spacer 538 to keep the thickness of the liquid crystal layer 532 constant, and a sealing material 539 to prevent the liquid crystal composition inside the liquid crystal 532 layer from leaking outside.

In the same manner as in the above-described liquid crystal device 520, the crossing portions between the first electrode 533 and the second electrode 536 form the pixels. It is thus so arranged that the color layers 508R, 508G, 508B of the color filter 500 are positioned in these portions which form the pixels.

Figure 17:
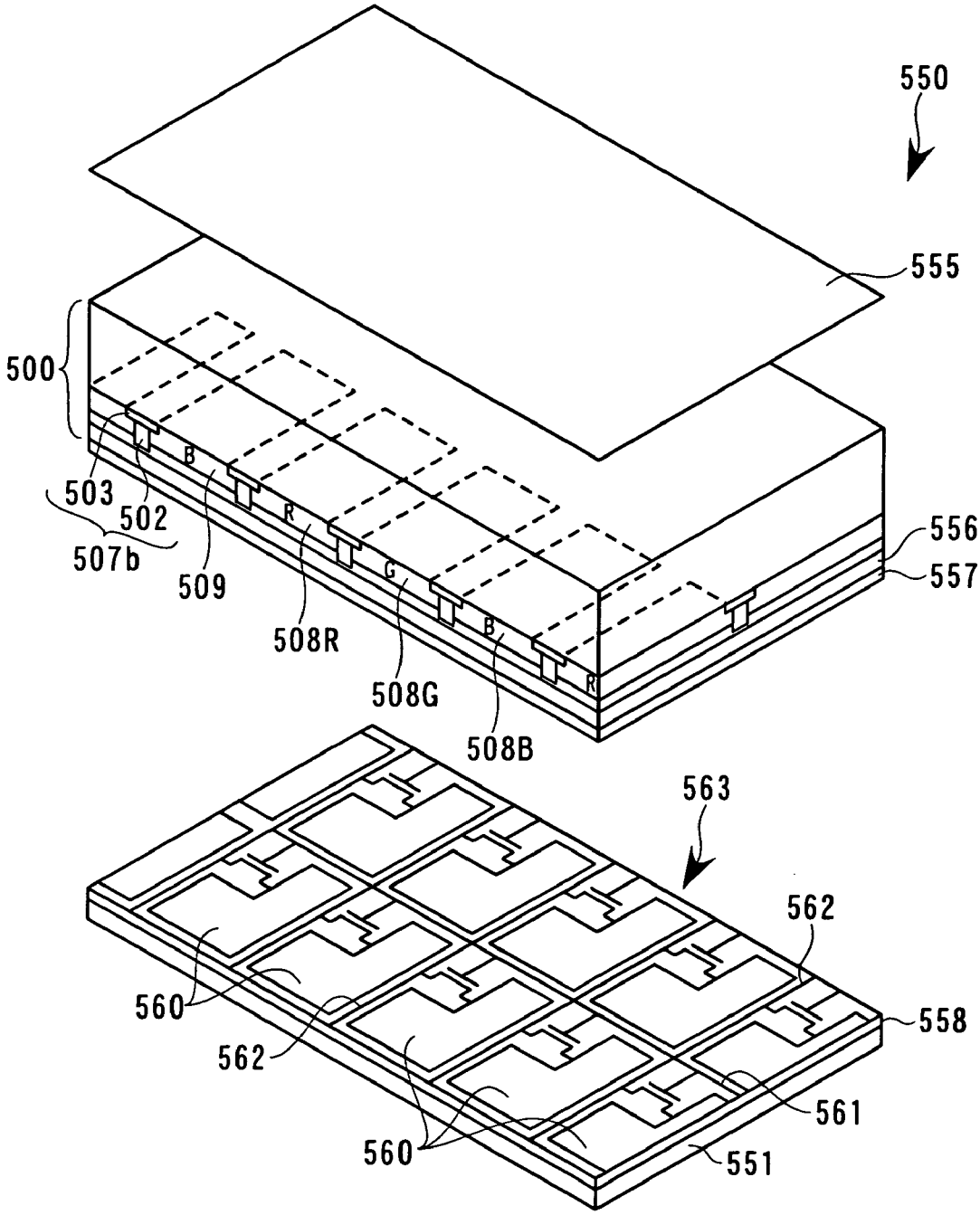
FIG. 17 is a sectional view of an important portion showing a general construction of a liquid crystal device of a third embodiment using the filter to which this invention is applied.

FIG. 17 is an exploded perspective view of an important portion showing a general structure of a transmission thin film transistor (TFT) type of liquid crystal device using a color filter 500 to which this invention is applied.

This liquid crystal device 550 has a construction in which the color filter 500 is disposed on an upper side as seen in the figure (i.e., on the side of the viewer).

This liquid crystal device 550 is made up of: a color filter 500; an opposite substrate 551 which is disposed to lie opposite to the color filter 500; a liquid crystal layer which is sandwiched therebetween; a polarizer 555 which is disposed on an upper side (on the side of the viewer) of the color filter 500; and a polarizer (not illustrated) which is disposed on the lower side of the opposite electrode 551.

On the surface (i.e., the surface on the side of the opposite substrate 551) of the protection film 509 of the color filter 500, there is formed an electrode 556 for the liquid crystal driving. This electrode 556 is made of a transparent conductive material such as ITO, or the like, and is formed into an entire-surface electrode which covers the entire region in which the pixel electrodes 560 (to be described later) are formed. An alignment layer 557 is disposed in a state of covering the opposite surface of this pixel electrodes 560 of the electrode 556.

On that surface of the opposite substrate 551 which lies opposite to the color filter 500, there is formed an insulating layer 558. On this insulating layer 558 there are formed scanning lines 561 and signal lines 562 in a state of crossing each other at right angles. Pixel electrodes 560 are formed inside the regions enclosed by the scanning lines 561 and the signal lines 562. In the actual liquid crystal device, there will be disposed an alignment layer (not illustrated) on the pixel electrode 560.

In the portion enclosed by the notched portion of the pixel electrode 560, the scanning line 561, and the signal line 562, there are built in or assembled a thin film transistor which is provided with a source electrode, a drain electrode, a semiconductor, and a gate electrode. By charging signals to the scanning line 561 and the signal line 562, the thin film transistor 563 can be switched on and off so as to control the supply of electric current to the pixel electrode 560.

Although the above-described liquid crystal devices 520, 530, 550 of each of the above embodiments is constituted into a transmission type, it may also be constituted into a reflective type of liquid crystal device or into a translucent reflective type of liquid crystal device by providing a reflective layer or a translucent reflective layer, respectively.

Figure 18:
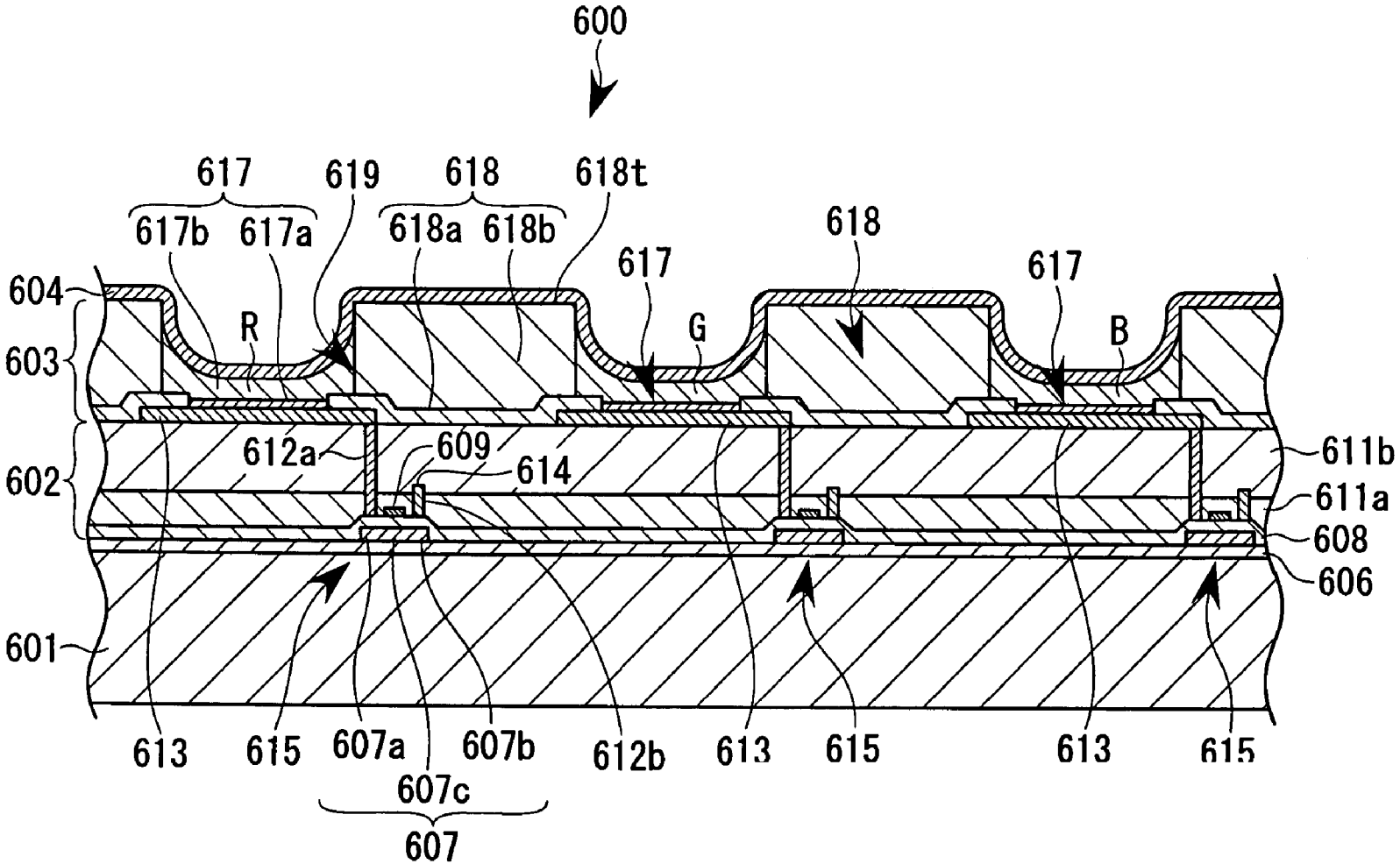
FIG. 18 is a sectional view of an important portion of a display device according to the second embodiment of this invention.

FIG. 18 is a sectional view of an important part of a display region of an organic EL device (hereinafter referred to as a display device 600).

This display device 600 is substantially constituted by a substrate 601 (W), and on this substrate are laminated a circuit element part 602, emitting element part 603 and a cathode 604.

In this display device 600, the light emitted from the emitting element part 603 toward the substrate 601 is transmitted through the circuit element part 602 and the substrate 601. The light emitted from the emitting element part 603 toward the side opposite to the substrate 601 is reflected by the cathode 604 and passes through the circuit element part 602 and the substrate 601 for ejection toward the viewer.

Between the circuit element part 602 and the substrate 601, there is formed a base protection film 606 which is made of a silicon oxide film. On top of this base protection film 606 (on the side of the emitting element 603), there is formed an island-shaped semiconductor film 607 which is made of polycrystalline silicon. In the left and right regions of this semiconductor film 607, there are respectively formed a source region 607*a* and a drain region 607*b* by high-concentration anion implantation. The central portion which is free from anion implantation becomes a channel region 607*c*.

In the circuit element part 602, there is formed a transparent gate insulation film 608 which covers the base protection film 606 and the semiconductor film 607. In that position on this gate insulation film 608 which corresponds to the channel region 607*c* of the semiconductor film 607, there is formed a gate electrode 609 which is made up of Al, Mo, Ta, Ti, W, or the like. On top of this gate electrode 609 and the gate insulation film 608, there are formed a transparent first interlayer insulator (interlayer dielectric film) 611*a* and a second interlayer insulator 611*b*. Through the first and second interlayer insulators 611*a*, 611*b*, there are formed contact holes 612*a*, 612*b* which are in communication with the source region 607*a* and the drain region 607*b*, respectively, of the semiconductor film 607.

On top of the second interlayer insulator 611*b*, there is formed, by patterning, a transparent pixel electrode 613 which is made of ITO, or the like. This pixel electrode 613 is connected to the source region 607*a* through the contact hole 612*a*.

On top of the first interlayer insulator 611*a*, there is formed an electric power source wiring 614, which is connected to the drain region 607*b* through the contact hole 612*b*.

As described hereinabove, the circuit element part 602 has formed therein a driving thin film transistor 615 which is connected to each of the pixel electrodes 613.

The above-described emitting element part 603 is made up of: a function layer 617 which is laminated on each of the plurality of pixel electrodes 613; and a bank part 618 which is provided between each of the pixel electrodes 613 and the function layers 617 to thereby partition each of the function layers 617.

The emitting element is constituted by these pixel electrodes 613, the function layer 617, and the cathode 604 which is disposed on the function layer 617. The pixel electrode 613 is formed into a substantial rectangle as seen in plan view, and the bank part 618 is formed between each of the pixel electrodes 613.

The bank part 618 is made up of: an inorganic-matter bank layer 618*a* (first bank layer) which is formed by inorganic materials such as SiO, $SiO_2$, $TiO_2$, or the like; and an organic-matter bank layer 618*b* (second bank layer) which is laminated on the inorganic-matter bank layer 618*a*, which is trapezoidal in cross section, and which is formed by a resist superior in heat-resistance and solvent-resistance such as an acrylic resin, a polyimide resin, or the like. Part of this bank part 618 is formed in a state of being overlapped with the peripheral portion of the pixel electrode 613.

Between each of the bank parts 618, there is formed an opening part 619 which gradually enlarges towards an upward.

The function layer 617 is made up of: a hole injection/transport layer 617*a* which is formed inside the opening part 619 in a state of being laminated on the pixel electrode 613; and an emitting layer 617*b* which is formed on this hole injection/transport layer 617*a*. It may be so arranged that other function layers having other functions are further formed adjacent to the emitting layer 617*b*. For example, an electron transport layer may be formed.

The hole injection/transport layer 617*a* has a function of transporting holes from the pixel electrode 613 side for injection into the emitting layer 617*b*. This hole injection/transport layer 617*a* is formed by ejecting the first composition of matter (function liquid) containing therein the hole injection/transport layer forming material. As the hole injection/transport layer forming material, there may be used a mixture of a polythiophene derivative such as polyethylenedioxythiophene and polystyrenesulfonoc acid, or the like.

The emitting layer 617*b* emits light of red (R), green (G) or blue (B), and is formed by ejecting the second composition of matter (function liquid) containing the emitting layer forming material (emitting material). The solvent (non-polar solvent) for the second composition of matter shall preferably be insoluble to the hole injection/transport layer 617*a* such as cyclohexylbenzene, diydeobenzofuran, trimethylbenzene, tetramethylbenzene, or the like. By using this kind of non-polar solvent as the second composition of matter of the emitting layer 617*b*, the emitting layer 617*b* can be formed without dissolving the hole injection/transport layer 617*a* again.

The emitting layer 617*b* is so arranged that the holes injected from the hole injection/transport layer 617*a* and the electron injected from the cathode 604 get bonded again in the emitting layer to thereby emit light.

The cathode 604 is formed in a state to cover the entire surface of the emitting element part 603, and forms a pair with the pixel electrode 613 to thereby cause the electric current to flow through the function layer 617. A sealing member (not illustrated) is disposed on top of this cathode 604.

Now, a description will be made about the manufacturing steps of the display device 600 with reference to FIGS. 19 through 37.

Figure 19:
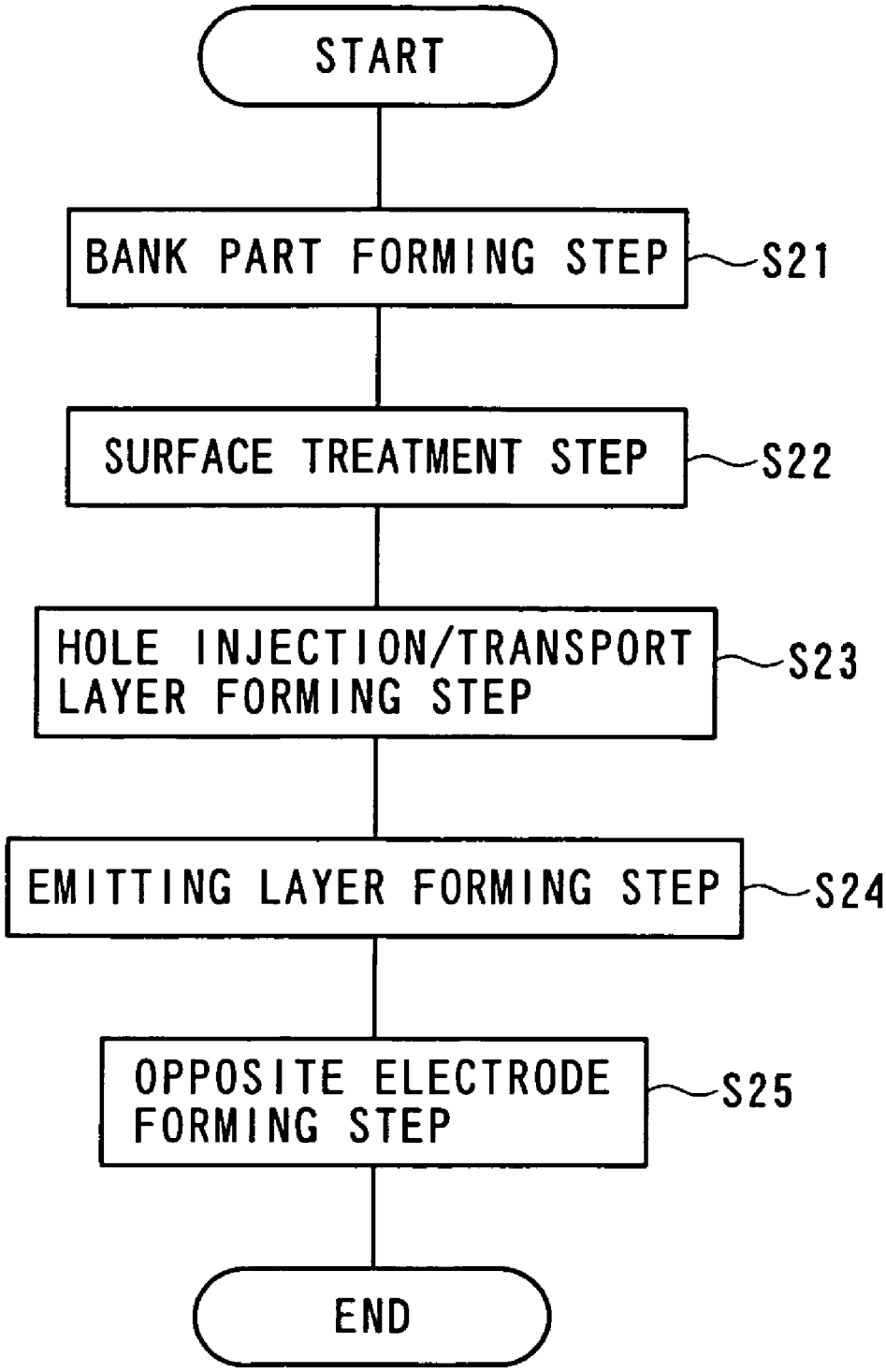
FIG. 19 is a flow chart showing the steps of manufacturing a display device which is an organic EL device.

As shown in FIG. 19, this display device 600 is manufactured through the following steps, i.e., a bank part forming step (S21), a surface treatment step (S22), a hole injection/transport layer forming step (S23), an emitting layer forming step (S24), and an opposite electrode forming step (S25). The manufacturing steps need not be limited to the illustrated ones; some steps may be omitted or others added if necessary.

Figure 20:
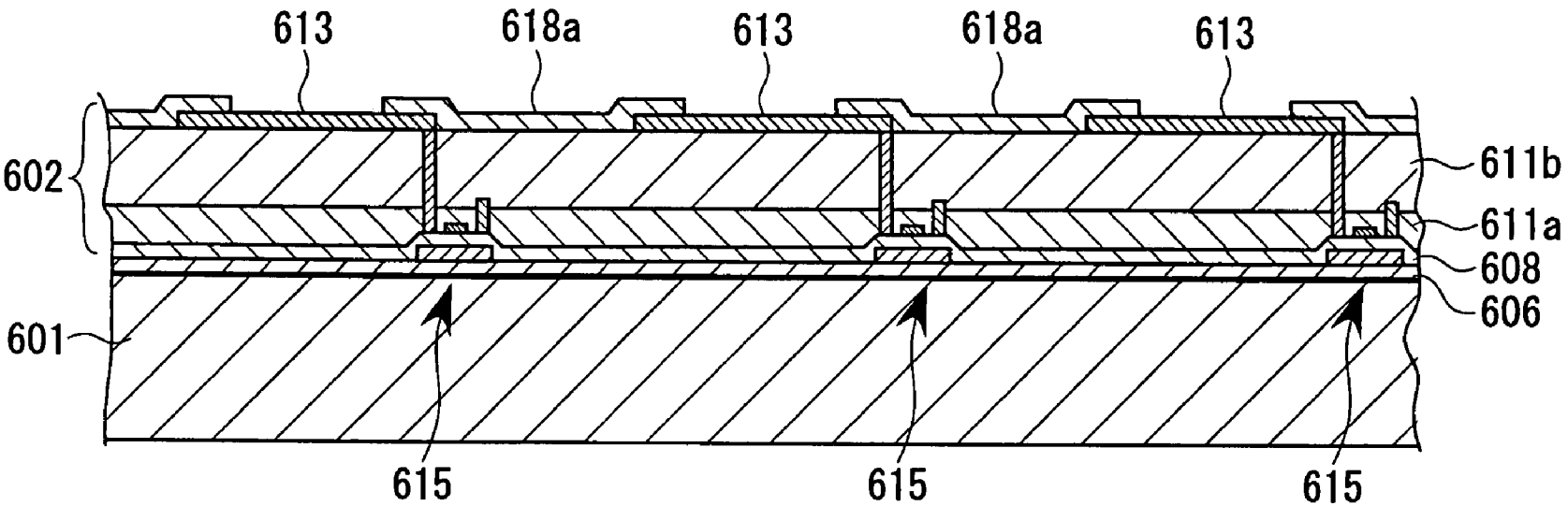
FIG. 20 is a diagram showing the process of forming an inorganic bank layer.

First, at the bank part forming step (S21), an inorganic-matter bank layer 618*a* is formed on the second interlayer insulator 611*b* as shown in FIG. 20. This inorganic-matter bank layer 618*a* is formed, after having formed an inorganic-matter film on the forming position, by patterning the inorganic-matter film by means of photolithography, or the like. At this time, part of the inorganic-matter bank layer 618*a* is formed so as to overlap with the peripheral portion of the pixel electrode 613.

Figure 21:
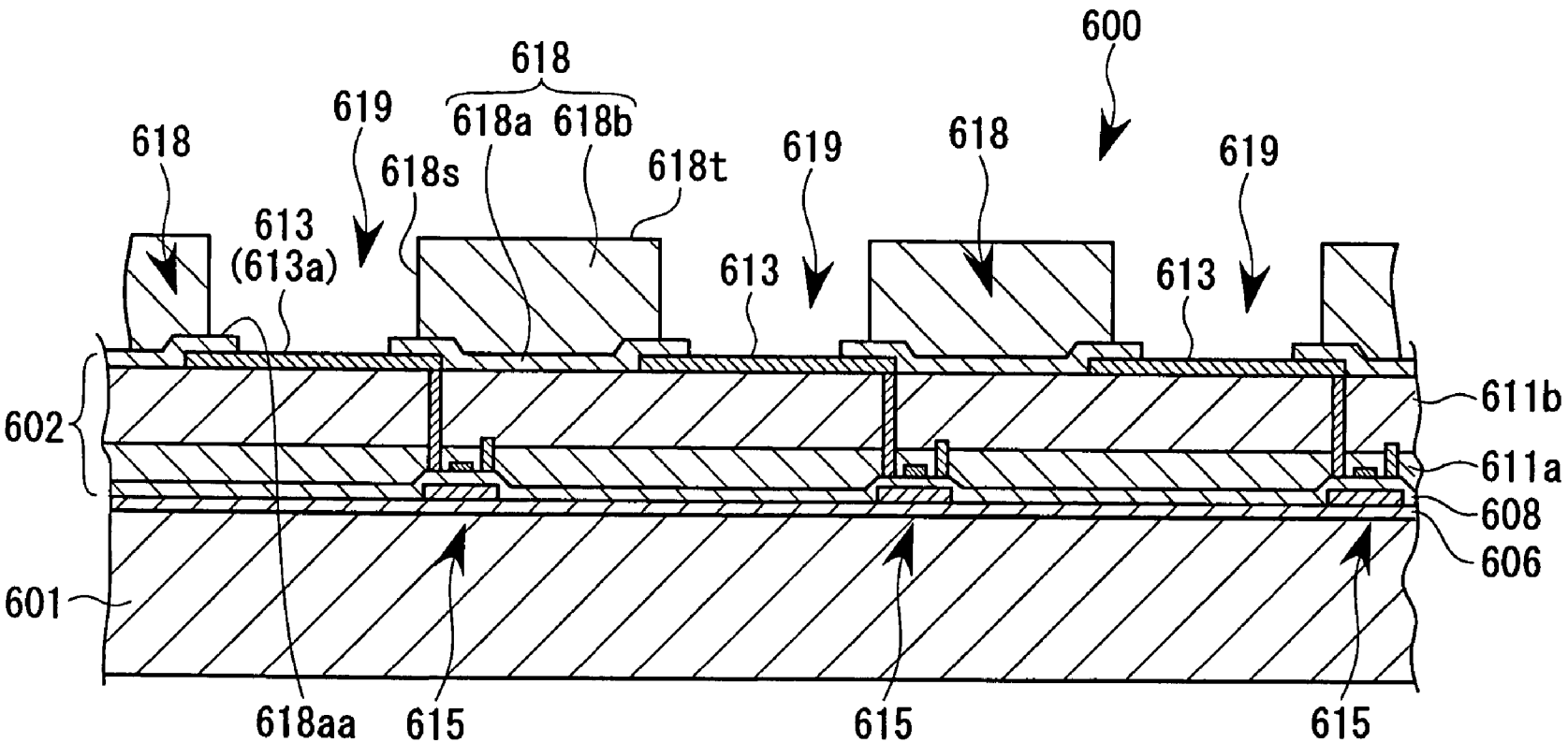
FIG. 21 is a diagram showing the process of forming an organic bank layer.

Once the inorganic-matter bank layer 618*a* has been formed, an organic-matter bank layer 618*b* is formed on top of the inorganic-matter bank layer 618*a* as shown in FIG. 21. This organic-matter bank layer 618*b* is formed, as in the case of the inorganic-matter bank layer 618*a*, by patterning by means of photolithography, or the like.

The bank part 618 is formed as described above. As a result, an opening part 619 which opens upward relative to the pixel electrode 613 is formed. This opening part 619 defines a pixel region.

At the surface treatment step (S22), the liquid-affinity processing (treatment to gain affinity to liquid) and the liquid-repellency processing (treatment to gain repellency to liquid) are performed. The region in which the liquid-affinity processing is to be performed are the first laminated part 618*aa* of the inorganic-matter bank layer 618*a* and the electrode surface 613*a* of the pixel electrode 613. These regions are subjected to surface treatment to obtain liquid affinity by means, e.g., of plasma processing using oxygen as the processing gas. This plasma processing also serves the purpose of cleaning the ITO which is the pixel electrode 613.

The liquid-repellency processing, on the other hand, is performed on the wall surface 618*s* of the organic-matter bank layer 618*b* and on the upper surface 618*t* of the organic-matter bank layer 618*b*. By means of plasma processing with, e.g., methane tetrafluoride as the processing gas, the surface is subjected to fluoridizing processing (processed to obtain liquid-repellent characteristic).

By performing this surface processing step, it becomes possible for the function liquid droplet to reach (or hit) the pixel region in a surer manner when the function layer 617 is formed by using the function liquid droplet ejection heads 26. It also becomes possible to prevent the function liquid droplet that has hit the pixel region from flowing out of the opening part 619.

Figure 2:
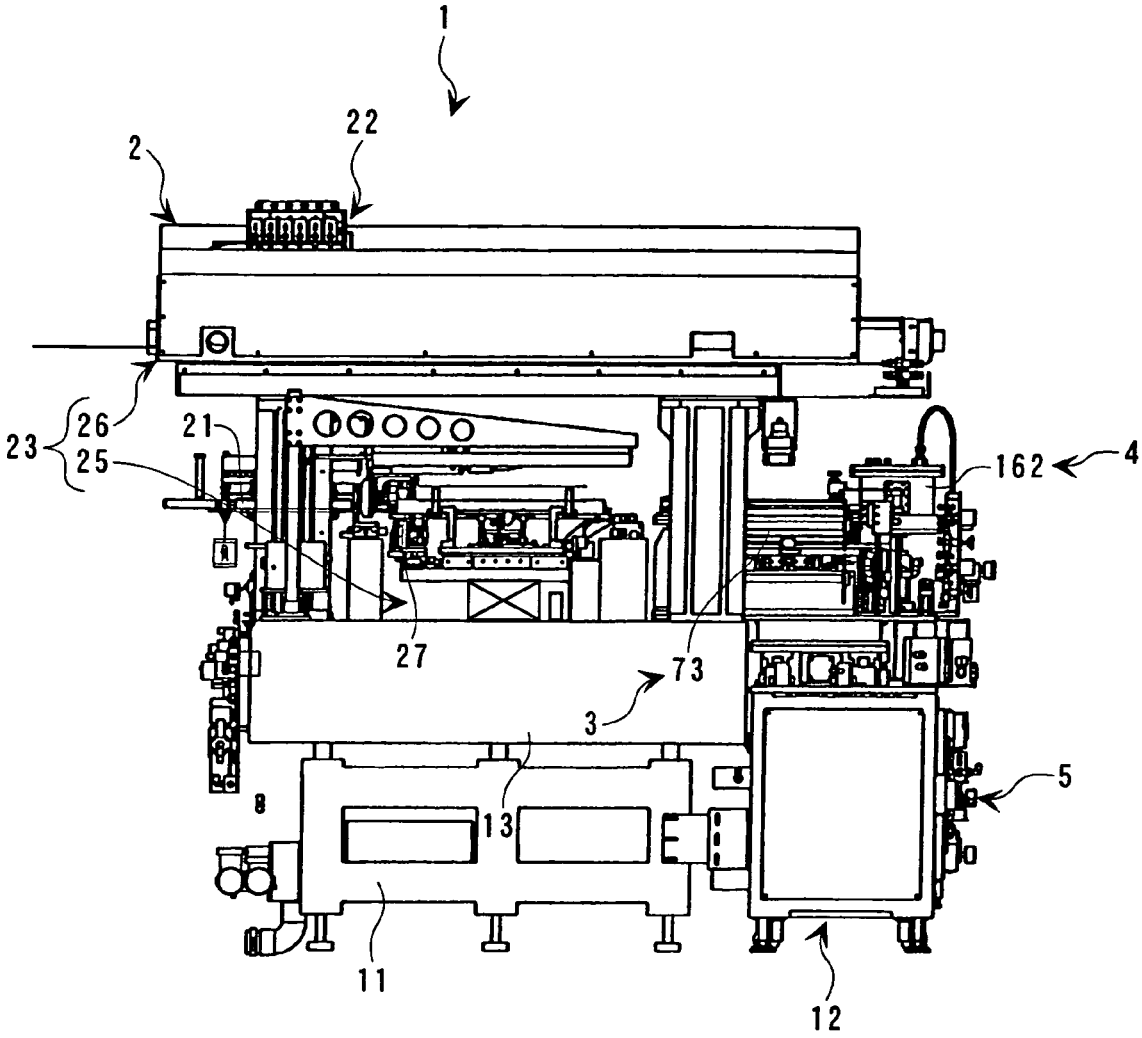
FIG. 2 is a front view thereof.

By going through the above-described steps, the display device base member 600A can be obtained. This display device base member 600A is mounted on the X-axis table 22 of the imaging apparatus 2 as shown in FIG. 2, and the following hole injection/transport layer forming step (S23) and the emitting layer forming step (S24) are performed.

Figure 22:
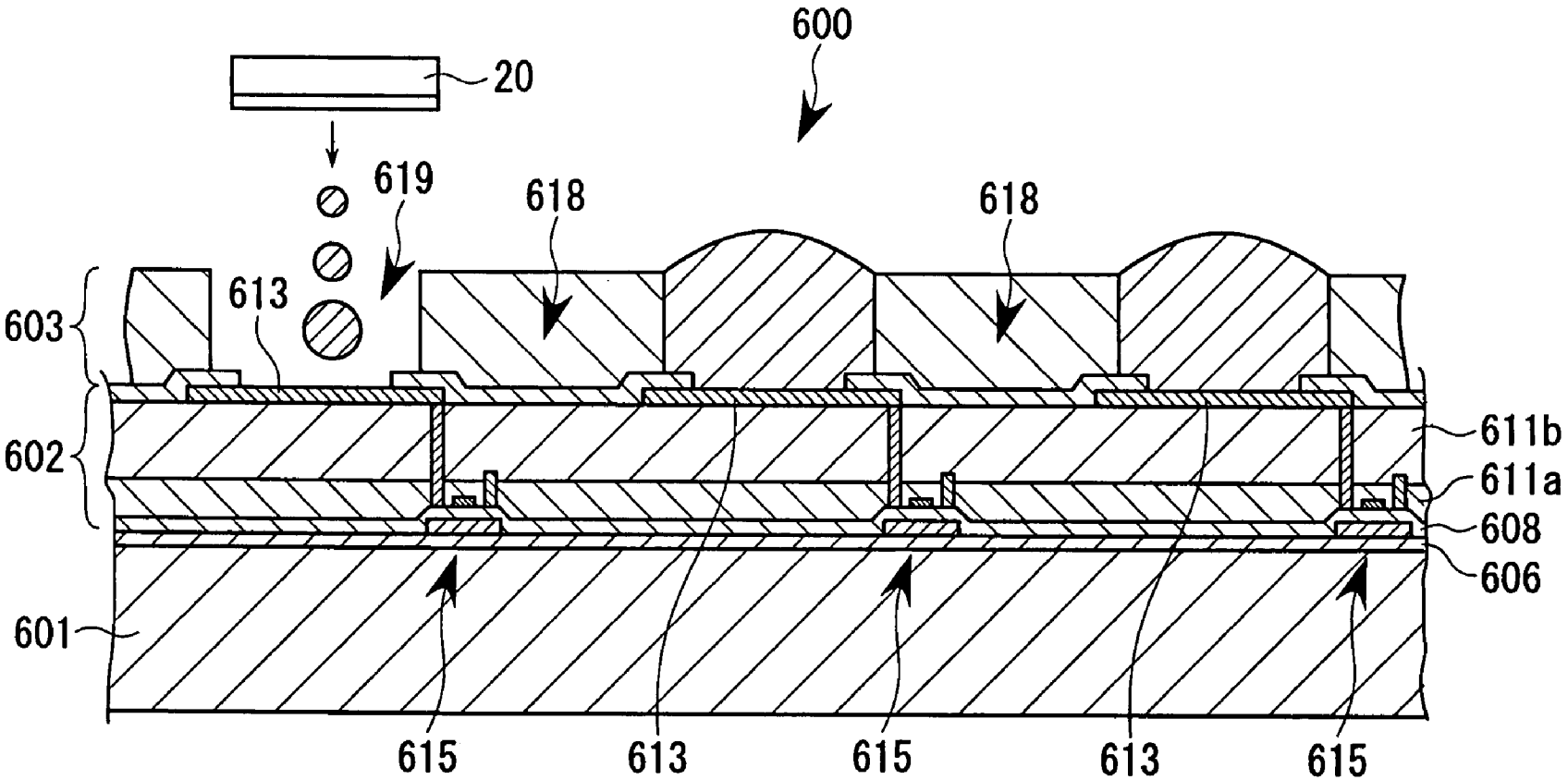
FIG. 22 is a schematic diagram showing the process of forming a hole injection/transport layer.
Figure 23:
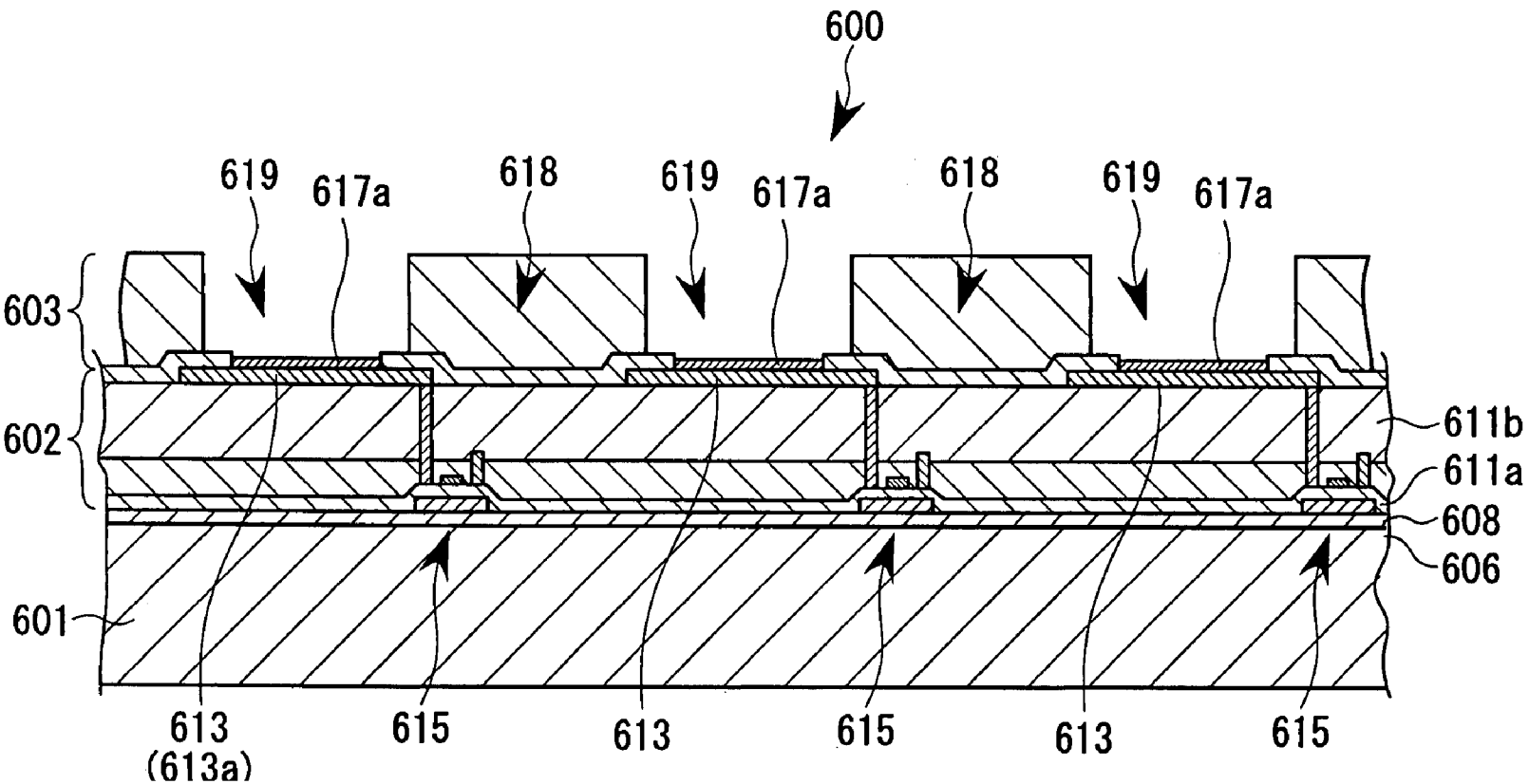
FIG. 23 is a schematic diagram showing the state in which the hole injection/transport layer has been formed.

As shown in FIG. 22, at the hole injection/transport layer forming step (S23), the first composition of matter containing therein the hole injection/transport layer forming material is ejected from the function liquid droplet ejection heads 20 into each of the opening parts 619. Thereafter, as shown in FIG. 23, drying process and heat-treatment process are performed in order to evaporate the polar solvent contained in the first composition of matter, whereby the hole injection/transport layer 617*a* is formed on the pixel electrode 613 (electrode surface 613*a*).

A description will now be made about the emitting layer forming step (S24). At this emitting layer forming step, as described above, in order to prevent the hole injection/transport layer 617*a* from getting resolved again, there is used a non-polar solvent which is insoluble to the hole injection/transport layer 617*a* as a solvent for the second composition of matter to be used in forming the emitting layer.

On the other hand, since the hole injection/transport layer 617*a* is low in affinity to the non-polar solvent, it will be impossible to closely adhere the hole injection/transport layer 617*a* to the emitting layer 617*b* or to uniformly coat the emitting layer 617*b* even if the second composition of matter containing therein the non-polar solvent is ejected onto the hole injection/transport layer 617*a*.

As a solution, in order to enhance the affinity of the surface of the hole injection/transport layer 617*a* to the non-polar solvent and to the emitting layer forming material, it is preferable to perform the surface treatment (treatment to improve the quality of the surface) before forming the emitting layer. This surface treatment is performed by coating the hole injection/transport layer 617*a* with a surface modifying material which is a solvent that is the same as, or similar to, the non-polar solvent of the second composition of matter to be used in forming the emitting layer, and then drying it.

By performing this kind of treatment, the surface of the hole injection/transport layer 617*a* easily conforms to the non-polar solvent. It becomes thus possible to uniformly coat, at a subsequent step, the hole injection/transport layer 617*a* with the second composition of matter containing therein the emitting layer forming material.

Figure 24:
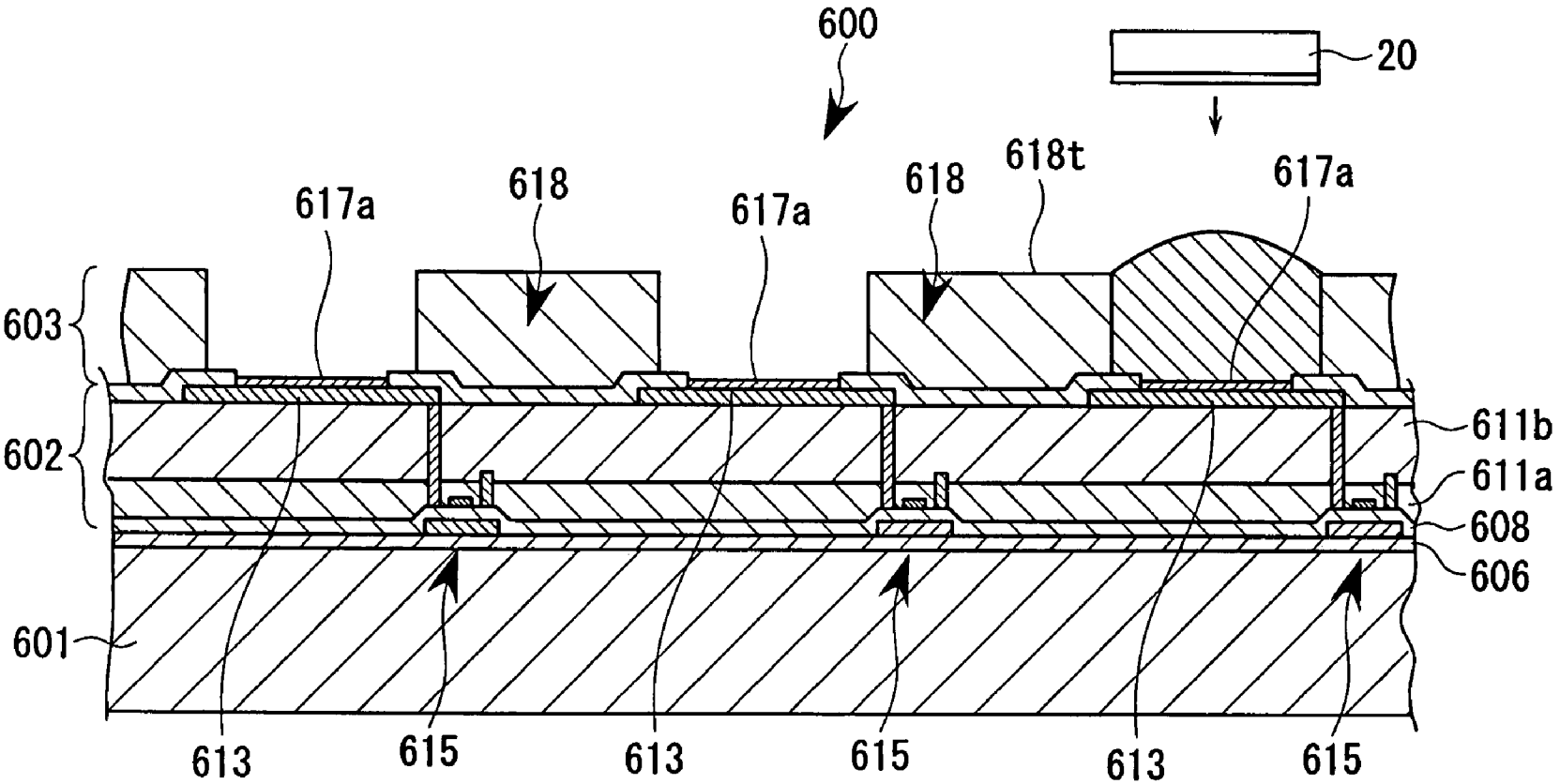
FIG. 24 is a schematic diagram showing the process of forming an emitting layer of blue color.

Thereafter, as shown in FIG. 24, the second composition of matter containing therein the emitting layer forming material corresponding to one of the colors (blue in the example in FIG. 34) is implanted into the pixel region (opening part 619) by a predetermined amount. The second composition of matter implanted into the pixel region gets spread over the hole injection/transport layer 617*a* to thereby fill the opening part 619. Even if the second composition of matter goes out of the pixel region to thereby hit the upper surface 618*t* of the bank part 618, since this upper surface 618*t* has been subject to the liquid-repellent treatment as described above, the second composition of matter is likely to be easily rolled into the opening part 619.

Figure 25:
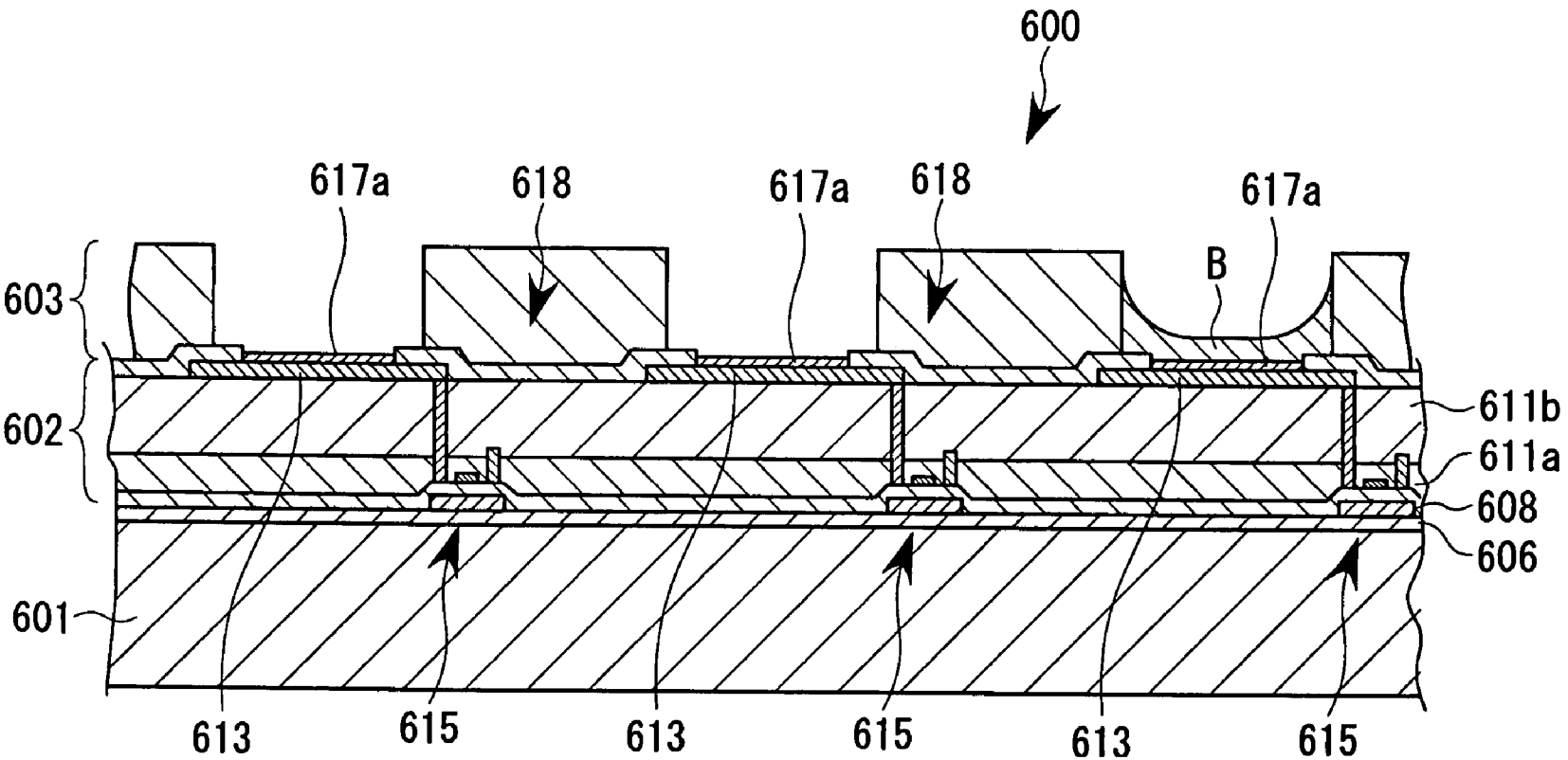
FIG. 25 is a schematic diagram showing the state in which the emitting layer of blue color has been formed.

Thereafter, by performing the drying step, or the like, the second composition of matter after ejection is processed by drying to thereby evaporate the non-polar solvent contained in the second composition of matter. The emitting layer 617*b* is thus formed on top of the hole injection/transport layer 617*a* as shown in FIG. 25. In this embodiment, there is formed an emitting layer 617*b* corresponding to the blue color (B).

By using the function liquid droplet ejection head 20, the steps like in the above-described emitting layer 617*b* corresponding to the blue color (B) are sequentially performed as shown in FIG. 26, whereby the emitting layers 617*b* corresponding to the other colors of red (R) and green (G) are formed. The order of forming the emitting layer 617*b* is not limited to the above-described embodiment, but may be arbitrarily determined. For example, it is possible to determine the order of forming depending on the materials to form the emitting layer.

In the manner as described hereinabove, the function layer 617, i.e., the hole injection/transport layer 617*a* and the emitting layer 617*b*, is formed on the pixel electrode 613. Then, the process transfers to the opposite electrode forming step (S25).

Figure 27:
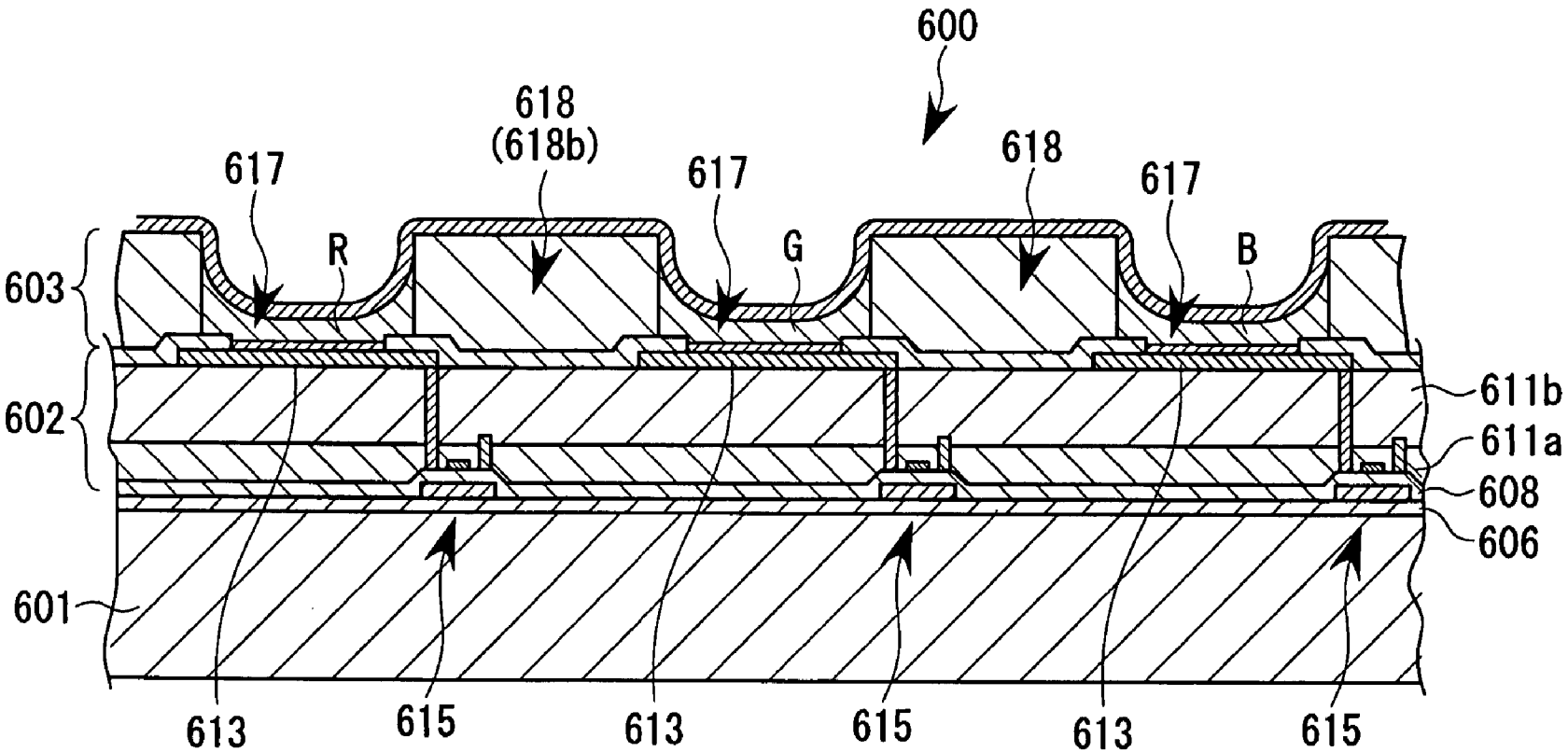
FIG. 27 is a schematic diagram showing the process of forming a cathode.

At the opposite electrode forming step (S25), as shown in FIG. 27, the cathode 604 (opposite electrode) is formed over the entire surfaces of the emitting layer 617*b* and the organic matter bank layer 618*b* by means of a vapor deposition method, sputtering method, chemical vapor deposition (CVD) method, or the like. This cathode 604 is constituted in this embodiment by laminating, e.g., a calcium layer and an aluminum layer.

On an upper part of the cathode 604, there are provided an Al film and an Ag film as electrodes and, on top thereof, a protection film for preventing oxidation such as an $SiO_2$ film, an SiN film, or the like, depending on necessity.

After having formed the cathode 604 as described above, a sealing process for sealing the upper portion of the cathode 604 with a sealing material, a wiring processing, or the like, are performed to thereby obtain the display device 600.

Figure 28:
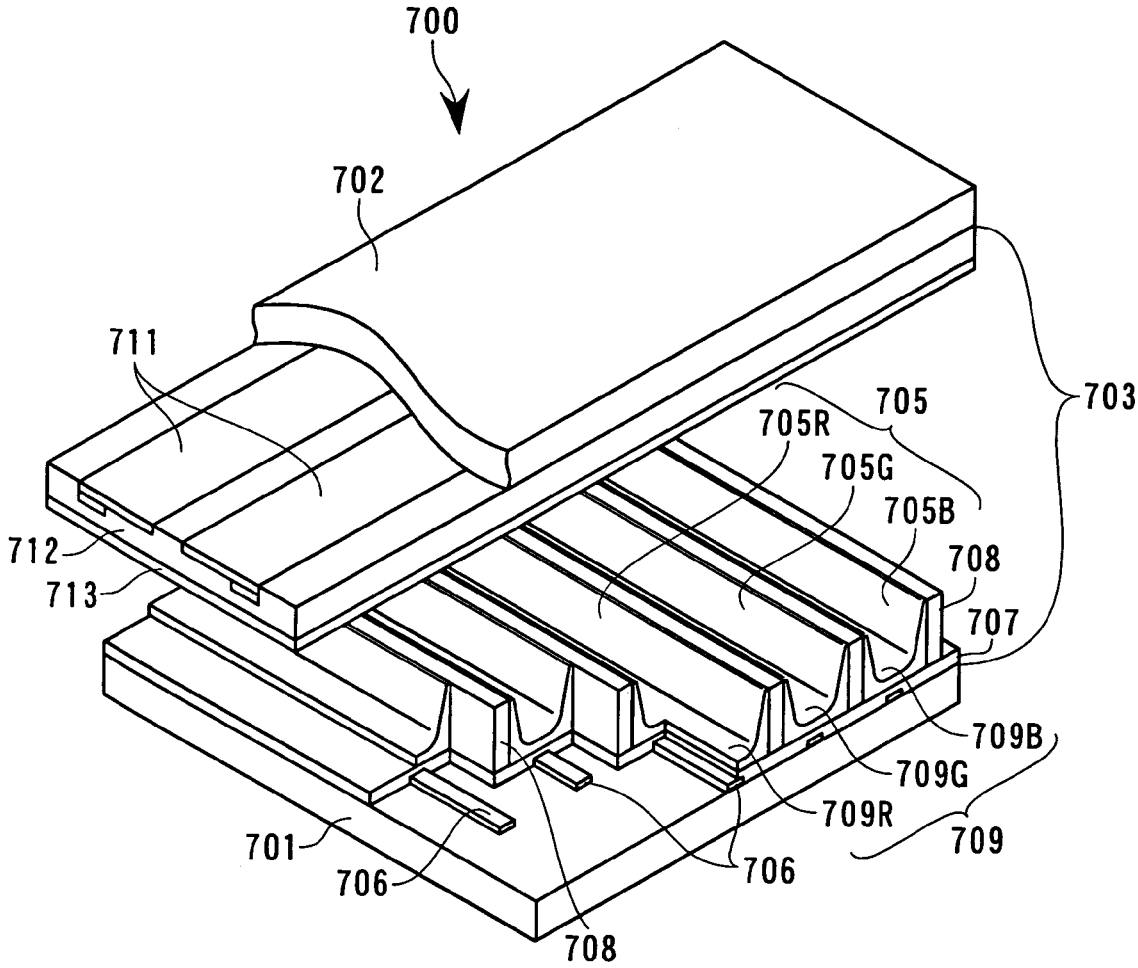
FIG. 28 is an exploded perspective view showing an important portion of a display device which is a plasma display (PDP) device.

FIG. 28 is an exploded perspective view showing an important part of the plasma type of display device (PDP device, simply referred to as a display device 700). In the figure, the display device 700 is shown in a partly cut away state.

This display device 700 is made up of a first substrate 701 and a second substrate 702 which are disposed to lie opposite to each other, as well as a discharge display part 703 which is formed therebetween. The discharge display part 703 is constituted by a plurality of discharging chambers 705. Among these plurality of discharging chambers 705, the three chambers 705 of a red discharging chamber 705R, a green discharging chamber 705G, and a blue discharging chamber 705B are disposed as a set to make one pixel.

On an upper surface of the first substrate 701, there are formed address electrodes 706 in a stripe form at a given distance from one another. A dielectric layer 707 is formed to cover these address electrodes 706 and the upper surface of the first substrate 701. On the dielectric layer 707, there are vertically disposed partition walls 708 which are positioned between respective address electrodes 707 in a manner to lie along the respective address electrodes 706. Some of these partition walls 708 extend on both widthwise sides of the address electrodes 706 and others (not illustrated) extend at right angles to the address electrodes 706.

The regions which are partitioned by these partition walls 708 form the discharge chambers 705.

Inside the discharge chambers 705, there are disposed fluorescent bodies 709. The fluorescent bodies 709 emit luminescent light of any one of red (R), green (G) and blue (B). At the bottom of the red discharging chamber 705R, there are disposed red fluorescent bodies 709R, at the bottom of the green discharging chamber 705G, there are disposed green fluorescent bodies 709R, and at the bottom of the blue discharging chamber 705B, there are disposed blue fluorescent bodies 709B, respectively.

On the lower side of the second substrate 702 as seen in the figure, there are formed a plurality of display electrodes 711 in a direction crossing the address electrodes 706 at right angles at a predetermined distance from one another. In a manner to cover them, there are formed a dielectric layer 712 and a protection film 713 which is made of MgO, or the like.

The first substrate 701 and the second substrate 702 are oppositely adhered to each other in a state in which the address electrodes 706 and the display electrodes 711 cross each other at right angles. The address electrodes 706 and the display electrodes 711 are connected to an AC power source (not illustrated).

By charging electricity to each of the electrodes 706, 711, the fluorescent bodies 709 are caused to emit light through excitation, whereby color display becomes possible.

In this embodiment, the address electrodes 706, the display electrodes 711, and the fluorescent bodies 709 can be formed by using the liquid droplet ejection apparatus 1 as shown in FIG. 1. A description will now be made about an embodiment of steps for manufacturing the address electrodes 706 on the first substrate 701.

In this case, the following steps are performed in a state in which the first substrate 126 is placed on the X-axis table 22 of the imaging apparatus 2.

First, by means of the function liquid droplet ejection head 20, the liquid material (function liquid) containing therein a material for forming the conductive film wiring is caused to hit the address electrode forming region as the function liquid droplet. This liquid material is prepared as the electrically conductive film wiring (wiring formed by electrically conductive film) by dispersing electrically conductive fine particles of metals, or the like, into a dispersion medium. As the electrically conductive fine particles, there are used metallic fine particles containing therein gold, silver, copper, palladium, nickel, or the like, or an electrically conductive polymer, or the like.

Once all of the address electrode forming regions in which the liquid material is scheduled to be filled have been filled therewith, the liquid material after ejection is dried to evaporate the dispersion medium contained in the liquid material, whereby the address electrodes 706 are formed.

An embodiment of the address electrodes 706 has been given hereinabove, but the display electrodes 711 and the fluorescent bodies 709 can also be formed by the above-described steps.

In forming the display electrodes 711, a liquid material (function liquid) containing therein the electrically conductive wiring forming material is caused to hit the display electrode forming region, in a similar manner as in the case of the address electrodes 706.

In forming the fluorescent bodies 709, on the other hand, a liquid material (function liquid) containing therein a fluorescent material corresponding to each of the colors (R, G, B) is ejected from the three function liquid droplet ejection heads 10 to thereby cause them to hit the discharge chambers 705 of corresponding colors.

Figure 29:
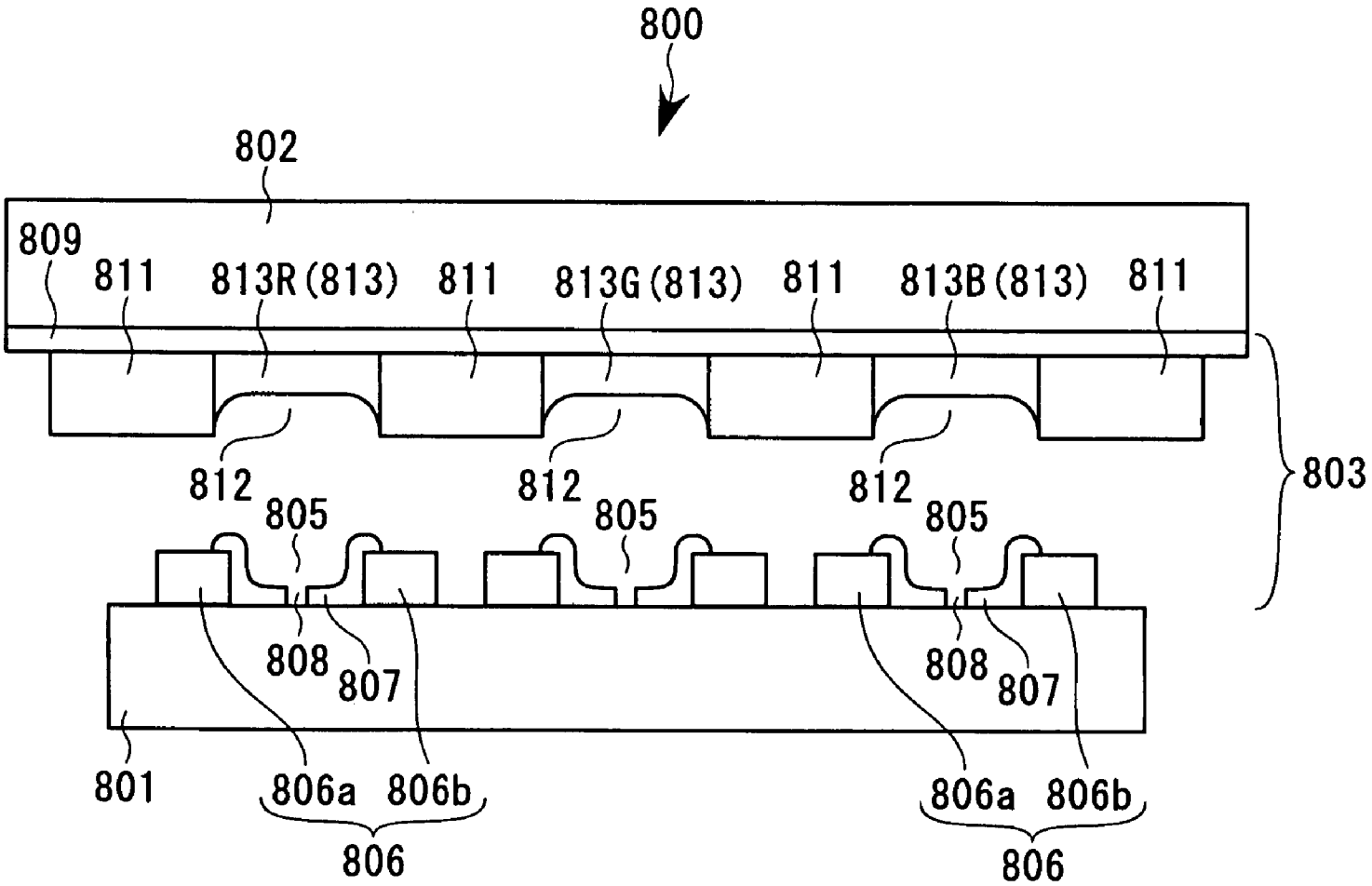
FIG. 29 is a sectional view showing an important portion of a display device which is an electron emission (FED) device.

FIG. 29 is a sectional view showing an important part of the electron emission device (FED device, hereinafter simply referred to as a display device 800). In the figure, the display device 800 is partly shown in section.

The display device 800 is substantially made up of a first substrate 801 and a second substrate 802 which are disposed opposite to each other, as well as a field emission display part 803 which is formed therebetween. The field emission display part 803 is constituted by a plurality of electron emission parts 805 which are arranged in matrix.

On an upper surface of the first substrate 801, there are formed first element electrodes 806*a* and second electrodes 806*b* which constitute cathode electrodes 806, in a manner to cross each other at right angles. In each of the portions partitioned by the first element electrodes 806*a* and the second element electrodes 806*b*, there is formed an element film 807 with a gap 808 formed therein. In other words, a plurality of electron emission parts 805 are constituted by the first element electrodes 806*a*, the second element electrodes 806*b* and the element film 807. The element film 807 is made, e.g., of palladium oxide (PdO), or the like, and the gap 808 is formed by the work called forming, or the like, after having formed the element film 807.

On a lower surface of the second substrate 802, there is formed an anode electrode 809 which lies opposite to the cathode electrode 806. On a lower surface of the anode electrode 809, there is formed a lattice-shaped bank part 811. In each of the downward-looking openings 812 enclosed by the bank part 811, there is disposed a fluorescent body 813 in a manner to correspond to the electron emission part 805. The fluorescent body 813 emits light of either red (R), green (G), and blue (B). In each of the opening parts 812, there is disposed a red fluorescent body 813R, a green fluorescent body 813G, and a blue fluorescent body 813B in a predetermined pattern.

The first substrate 801 and the second substrate 802 constituted as described above are adhered to each other at a very small gap therebetween. In this display device 800, the electrons to be emitted from the first element electrode 806*a* and the second element electrode 806*b* as the cathode are excited and caused to emit light through the element film (gap 808) 807 by causing them to hit the fluorescent body 813 formed on the anode electrode 809 which is the anode. Color display is thus possible.

In this case, too, as in the other embodiments, the first element electrode 806*a*, the second element electrode 806*b*, and the anode electrode 809 can be formed by using the image forming apparatus 2. Fluorescent bodies 813R, 813G, 813B of each color can be formed by using the imaging apparatus 2.

Figure 30A:
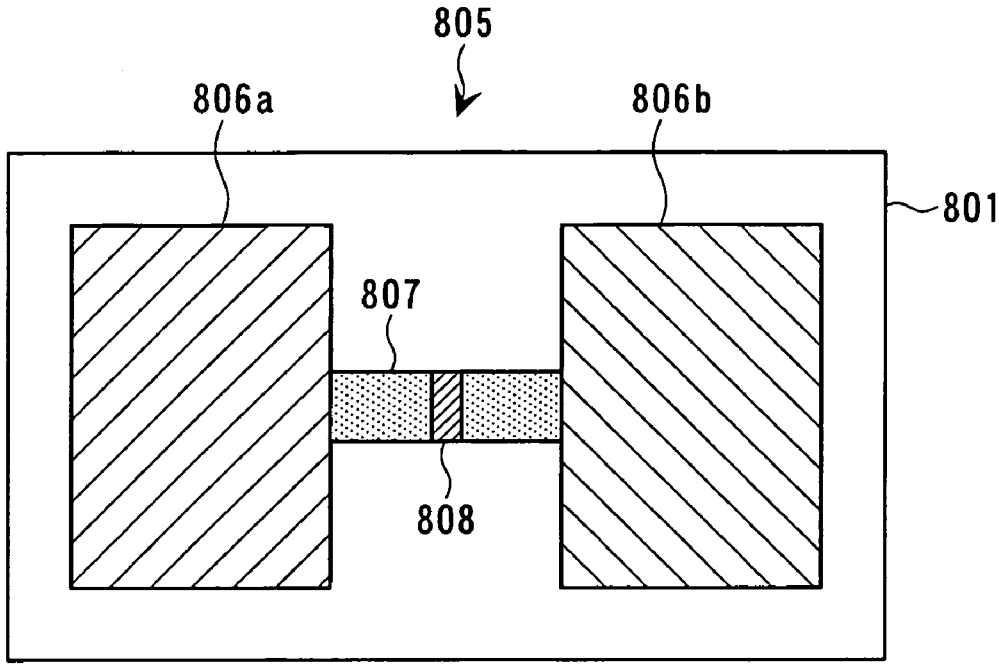
FIG. 30A is a plan view around an electron emission part of the display device and FIG. 30B is a plan view showing the method of forming the same.
Figure 30B:
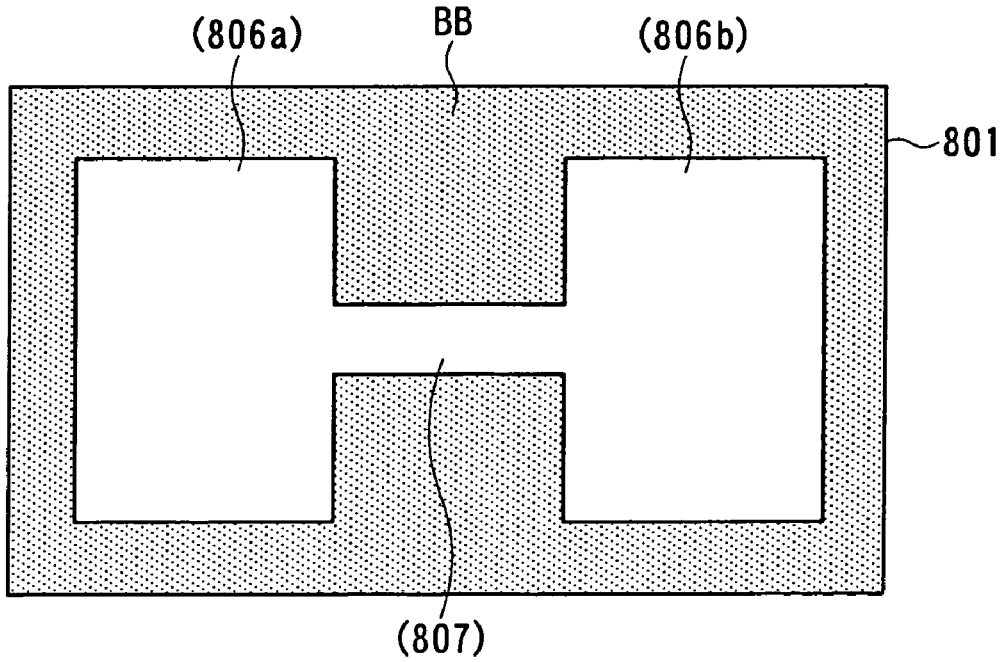

The first element electrode 806*a*, the second element electrode 806*b* and the electrically conductive film 807 has a flat shape as shown in FIG. 30A. In forming this film, as shown in FIG. 30B, the bank portion BB is formed by photolithographic method while leaving the portions in which the first element electrode 806*a*, the second element electrode 806*b*, and the electrically conductive film 807 are formed. Then, in the groove portion which is constituted by the bank portion BB, the first element electrode 806*a* and the second element electrode 806*b* are formed (by ink jet method with the imaging apparatus 2). After the solvent is dried and the film is formed, the electrically conductive film 807 is formed (in the ink jet method with the imaging apparatus 2). Then, after having formed the electrically conductive film 807, the bank portion BB is removed (peeling by the processing called ashing), and the process proceeds to the above-described forming processing. In the same manner as in the above-described organic EL device, it is preferable to perform the liquid-affinity processing to the first substrate 801 and the second substrate 802, as well as the liquid-repellency processing to the bank portion 811, BB.

As the other electrooptic apparatus, there can be considered an apparatus for forming a metallic wire, for forming a lens, for forming a resist, for forming a light diffusion body, or the like.

According to this invention, a ventilation flow can be caused to flow through the clearance between the hot plates vertically disposed in a plurality of stages inside the drying furnace. The solvent, or the like, to be evaporated during drying can be quickly discharged out f the furnace. Therefore, the small and simple drying furnace can dry the plurality of workpieces efficiently at the same time.

The entire disclosure of Japanese Patent Application Nos. 2002-342713 filed Nov. 26, 2002 and 2003-297220 filed Aug. 21, 2003 are hereby incorporated by reference.

What is claimed is:

1. A method of filling a flow passage inside a liquid droplet ejection head with a function liquid, comprising the steps of:

sending under pressure the function liquid for filling into the flow passage inside the liquid droplet ejection head; and thereafter sucking the function liquid out of a nozzle of the liquid droplet ejection head;

wherein a flow velocity of the function liquid at each part at the step of sending the function liquid under pressure is lower than a flow velocity of the function liquid at each part at the step of sucking the function liquid.

2. The method according to claim 1, wherein the step of sucking is performed in a state in which a suction cap is closely adhered to the liquid droplet ejection head, and wherein the step of sending the function liquid under pressure is performed in a state in which the function liquid to be discharged from the nozzle is capable of being received by the cap.

3. The method according to claim 1, wherein the step of sucking the function liquid is performed in a state in which the suction cap is kept adhered to the liquid droplet ejection head and, at a final stage, the suction cap is departed while continuing the sucking operation.

4. A method of filling a flow passage inside a liquid droplet ejection head with a function liquid, comprising the steps of:

sending under pressure the function liquid for filling into the flow passage inside the liquid droplet ejection head;

thereafter sucking the function liquid out of a nozzle of the liquid droplet ejection head; and after the step of sucking the function liquid, temporarily sending under pressure the function liquid to the liquid droplet ejection head.

5. An apparatus for filling a flow passage inside a liquid droplet ejection head with a function liquid inside a function liquid storing part, comprising:

pressurized liquid sending means for sending under pressure the function liquid, by pressurizing the function liquid storing part, to thereby fill the flow passage inside the liquid droplet ejection head with the function liquid inside the function liquid storing part;

sucking means for sucking the function liquid out of a nozzle of the liquid droplet ejection head through a cap which is in close contact with the liquid droplet ejection head; and control means for controlling the pressurized liquid sending means and the sucking means, wherein the control means drives the pressurized liquid sending means to thereby fill the flow passage inside a liquid droplet ejection head and thereafter drives the sucking means to thereby suck the function liquid from the liquid droplet ejection head;

wherein the control means starts the driving of the suction means after the driving of the pressurized liquid sending means is stopped; and wherein the pressurized liquid sending means comprises:

a compressed air supply source for supplying the function liquid storing part with compressed air;

a pressurizing pipe which connects the compressed air supply source and the function liquid storing part; and a pressurizing-side gate valve which is interposed in the pressurizing pipe and which is controlled to be opened and closed by the control means;

wherein driving and stopping of the pressurized liquid sending means are made by opening and closing of the pressurizing-side gate valve.

6. The apparatus according to claim 5, wherein the cap also serves as a receptacle to receive the function liquid to be discharged from the nozzle of the liquid droplet ejection head as a result of driving of the pressurized liquid sending means.

7. The apparatus according to claim 6, wherein the suction means comprises an access-and-departure mechanism for relatively moving the cap toward, and away from, the liquid droplet ejection head, and wherein at a last stage the control means moves, by the access-and departure mechanism, the cap away from the liquid droplet ejection head by the driving of the suction means while continuing the driving of the suction means.

8. A liquid droplet ejection apparatus comprising:

a function liquid filling apparatus for the liquid droplet ejection head as set forth in claim 5; and a liquid droplet ejection head for ejecting the function liquid from the nozzle by performing scanning relative to a workpiece.

9. The apparatus according to claim 8, wherein the function liquid filling apparatus for the liquid droplet ejection head further comprises a main tank which stores the function liquid to be supplied to the function liquid storing part and which causes the function liquid storing part to serve as a sub-tank, and wherein the pressurized liquid sending means also serves a function of supply means for supplying the function liquid from the main tank to the function liquid storing part.

10. An electrooptic device comprising a film forming part which is formed on a substrate by the function liquid ejected from the liquid droplet ejection head by using the liquid droplet ejection apparatus as set forth in claim 8.

11. An electronic apparatus comprising the electrooptic device as set forth in claim 10.

12. A method of manufacturing an electrooptic device comprising the step of forming on a substrate a film forming part by ejecting the function liquid from the function liquid droplet ejection by using the liquid droplet ejection apparatus of claim 8.

13. An apparatus for filling a flow passage inside a liquid droplet ejection head with a function liquid inside a function liquid storing part, comprising:

pressurized liquid sending means for sending under pressure the function liquid, by pressurizing the function liquid storing part, to thereby fill the flow passage inside the liquid droplet ejection head with the function liquid inside the function liquid storing part;

sucking means for sucking the function liquid out of a nozzle of the liquid droplet ejection head through a cap which is in close contact with the liquid droplet ejection head;

control means for controlling the pressurized liquid sending means and the sucking means, and a gate valve which is interposed in a supply passage and which is opened and closed by the control means, wherein the control means drives the pressurized liquid sending means to thereby fill the flow passage inside a liquid droplet ejection head and thereafter drives the sucking means to thereby suck the function liquid from the liquid droplet ejection head; and wherein the control means closes the gate valve before start of driving of the suction means, starts driving of the suction means after closing the gate valve, and opens the gate valve while the suction means is being driven.

14. The apparatus according to claim 13, wherein the control means opens and closes the gate valve for a plurality of times while the suction means is being driven.

15. The apparatus according to claim 13, wherein the gate valve is interposed in the supply passage close to the liquid droplet ejection head.

16. An apparatus for filling a flow passage inside a liquid droplet ejection head with a function liquid inside a function liquid storing part, comprising:

pressurized liquid sending means for sending under pressure the function liquid, by pressurizing the function liquid storing part, to thereby fill the flow passage inside the liquid droplet ejection head with the function liquid inside the function liquid storing part;

sucking means for sucking the function liquid out of a nozzle of the liquid droplet ejection head through a cap which is in close contact with the liquid droplet ejection head; and control means for controlling the pressurized liquid sending means and the sucking means, wherein the control means drives the pressurized liquid sending means to thereby fill the flow passage inside a liquid droplet ejection head and thereafter drives the sucking means to thereby suck the function liquid from the liquid droplet ejection head; and wherein the control means controls the pressurized liquid sending means and the suction means such that a flow velocity of the function liquid by the pressurized liquid sending means becomes smaller than a flow velocity of the function liquid by the suction means.

17. An apparatus for filling a flow passage inside a liquid droplet ejection head with a function liquid inside a function liquid storing part, comprising:

pressurized liquid sending means for sending under pressure the function liquid, by pressurizing the function liquid storing part, to thereby fill the flow passage inside the liquid droplet ejection head with the function liquid inside the function liquid storing part;

sucking means for sucking the function liquid out of a nozzle of the liquid droplet ejection head through a cap which is in close contact with the liquid droplet ejection head; and control means for controlling the pressurized liquid sending means and the sucking means.

wherein the control means drives the pressurized liquid sending means to thereby fill the flow passage inside a liquid droplet ejection head and thereafter drives the sucking means to thereby suck the function liquid from the liquid droplet ejection head; and wherein the control means temporarily drives the pressurized liquid sending means after the driving of the suction means has been stopped.

* * * * *